US010480851B2

(12) United States Patent
Ducote, Jr. et al.

(10) Patent No.: US 10,480,851 B2
(45) Date of Patent: Nov. 19, 2019

(54) MIXED REFRIGERANT SYSTEM AND METHOD

(71) Applicant: CHART ENERGY & CHEMICALS, INC., Cleveland, OH (US)

(72) Inventors: Douglas A. Ducote, Jr., The Woodlands, TX (US); Timothy P. Gushanas, Pearland, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 693 days.

(21) Appl. No.: 14/218,949

(22) Filed: Mar. 18, 2014

(65) Prior Publication Data

US 2014/0260415 A1 Sep. 18, 2014

Related U.S. Application Data

(60) Provisional application No. 61/802,350, filed on Mar. 15, 2013.

(51) Int. Cl.

| | |
|---|---|
| ***F25J 1/00*** | (2006.01) |
| ***F25J 1/02*** | (2006.01) |
| ***F25B 9/00*** | (2006.01) |

(52) U.S. Cl.

CPC ..... *F25J 1/0022* (2013.01); *F25B 9/006* (2013.01); *F25J 1/0055* (2013.01); *F25J 1/0212* (2013.01); *F25J 1/0262* (2013.01); *F25J 1/0291* (2013.01); *F25J 2220/64* (2013.01); *F25J 2290/32* (2013.01)

(58) Field of Classification Search

CPC ..... F25J 1/0055; F25J 1/0212; F25J 2270/12; F25J 2270/66

See application file for complete search history.

(56) References Cited

U.S. PATENT DOCUMENTS

| | | | |
|---|---|---|---|
| 2,041,725 | A | 7/1934 | Podbielniak |
| 3,364,685 | A | 1/1968 | Perret |
| 3,645,106 | A | 2/1972 | Lee |
| 3,729,945 | A | 5/1973 | Linnett |
| 4,033,735 | A | 7/1977 | Swenson |
| 4,057,972 | A | 11/1977 | Sarsten |
| 4,112,700 | A | 9/1978 | Forg |
| RE30,085 | E | 8/1979 | Perret |
| 4,251,247 | A | 2/1981 | Gauberthier |
| 4,274,849 | A | 6/1981 | Garier et al. |
| 4,504,296 | A | 3/1985 | Newton |

(Continued)

FOREIGN PATENT DOCUMENTS

| | | | |
|---|---|---|---|
| CA | 2322400 A | * | 4/2001 |
| CN | 202361751 U | | 8/2012 |

(Continued)

OTHER PUBLICATIONS

English translation of CN 202361751 provided by Espacenet. Feb. 2018.*

(Continued)

*Primary Examiner* — Tareq Alosh

(74) *Attorney, Agent, or Firm* — Cook Alex Ltd.; R. Blake Johnston

(57) ABSTRACT

Provided are mixed refrigerant systems and methods and, more particularly, to a mixed refrigerant system and methods that provides greater efficiency and reduced power consumption.

23 Claims, 23 Drawing Sheets

(56) References Cited

U.S. PATENT DOCUMENTS

| | | | | |
|---|---|---|---|---|
| 4,525,185 | A | 6/1985 | Newton | |
| 4,545,795 | A | 10/1985 | Liu et al. | |
| 4,586,942 | A | 5/1986 | Gauthier | |
| 4,689,063 | A | 8/1987 | Paradowski et al. | |
| 4,856,942 | A | 8/1989 | Bernadic et al. | |
| 4,901,533 | A | 2/1990 | Fan et al. | |
| 5,535,594 | A * | 7/1996 | Grenier | F25J 1/0022 62/612 |
| 5,644,931 | A | 7/1997 | Ueno et al. | |
| 5,657,643 | A | 8/1997 | Price | |
| 5,718,126 | A | 2/1998 | Capron et al. | |
| 5,746,066 | A | 5/1998 | Manley | |
| 5,768,912 | A | 6/1998 | Dubar | |
| 5,813,250 | A | 9/1998 | Ueno et al. | |
| 5,950,450 | A | 9/1999 | Bowen et al. | |
| 6,041,619 | A | 3/2000 | Fischer et al. | |
| 6,065,305 | A | 5/2000 | Arman et al. | |
| 6,250,105 | B1 | 6/2001 | Kimble | |
| 6,253,574 | B1 | 7/2001 | Stockmann | |
| 6,269,655 | B1 | 8/2001 | Roberts | |
| 6,289,692 | B1 | 9/2001 | Houser | |
| 6,295,833 | B1 | 10/2001 | Hoffart | |
| 6,298,688 | B1 | 10/2001 | Brostow | |
| 6,308,531 | B1 | 10/2001 | Roberts | |
| 6,324,867 | B1 | 12/2001 | Fanning | |
| 6,334,334 | B1 | 1/2002 | Stockmann et al. | |
| 6,347,531 | B1 | 2/2002 | Roberts et al. | |
| 6,347,532 | B1 | 2/2002 | Agrawal | |
| 6,367,286 | B1 | 4/2002 | Price | |
| 6,378,330 | B1 | 4/2002 | Minta | |
| 6,389,844 | B1 | 5/2002 | Klein Nagel Voort | |
| 6,449,984 | B1 | 9/2002 | Paradowski | |
| 6,530,240 | B1 | 3/2003 | Kount | |
| 6,622,518 | B2 | 9/2003 | Park | |
| 6,694,774 | B1 | 2/2004 | Rashad | |
| 6,725,688 | B2 | 4/2004 | Elion | |
| 6,742,357 | B1 | 6/2004 | Roberts | |
| 7,082,787 | B2 | 8/2006 | Lee | |
| 7,086,251 | B2 | 8/2006 | Roberts | |
| 7,127,914 | B2 | 10/2006 | Roberts | |
| 7,308,805 | B2 | 12/2007 | Roberts | |
| 7,310,971 | B2 | 12/2007 | Eaton | |
| 7,415,840 | B2 | 8/2008 | Eaton | |
| 7,565,815 | B2 | 7/2009 | Wilkinson | |
| 7,591,149 | B2 | 9/2009 | Ransbarger | |
| 7,628,035 | B2 | 12/2009 | Paradowski | |
| 7,673,476 | B2 | 3/2010 | Whitesell | |
| 8,020,406 | B2 | 9/2011 | Vandor | |
| 8,117,852 | B2 | 2/2012 | Mak | |
| 8,181,481 | B2 | 5/2012 | Jager | |
| 8,273,152 | B2 | 9/2012 | Schwartz | |
| 8,312,734 | B2 | 11/2012 | Lewis | |
| 8,418,481 | B2 | 4/2013 | Minor | |
| 8,424,340 | B2 | 4/2013 | Eaton | |
| 8,434,325 | B2 | 5/2013 | Martinez | |
| 8,438,874 | B2 | 5/2013 | Koganezawa | |
| 8,464,551 | B2 | 6/2013 | Roberts | |
| 2004/0231359 | A1 | 11/2004 | Brostow | |
| 2005/0198998 | A1 * | 9/2005 | Lee | F25J 3/0219 62/612 |
| 2007/0227185 | A1 | 10/2007 | Stone et al. | |
| 2007/0283718 | A1 | 12/2007 | Hulsey et al. | |
| 2008/0016910 | A1 | 1/2008 | Brostow et al. | |
| 2008/0141711 | A1 | 6/2008 | Roberts | |
| 2009/0071190 | A1 | 3/2009 | Potthoff | |
| 2009/0205366 | A1 | 8/2009 | Schmidt | |
| 2009/0217701 | A1 | 9/2009 | Minta | |
| 2009/0241593 | A1 | 10/2009 | Jager et al. | |
| 2010/0031699 | A1 | 2/2010 | Dam | |
| 2010/0147024 | A1 | 6/2010 | Roberts | |
| 2010/0154469 | A1 | 6/2010 | Eaton | |
| 2010/0186445 | A1 | 7/2010 | Minta | |
| 2010/0281915 | A1 | 11/2010 | Roberts | |
| 2011/0185767 | A1 | 8/2011 | Jager | |
| 2011/0219819 | A1 | 9/2011 | Bauer et al. | |
| 2011/0226008 | A1 | 9/2011 | Gushanas et al. | |
| 2012/0047943 | A1 | 3/2012 | Barclay et al. | |
| 2012/0067080 | A1 | 3/2012 | Byfield | |
| 2012/0137726 | A1 | 6/2012 | Currence | |
| 2013/0008204 | A1 | 1/2013 | Kim | |
| 2013/0061632 | A1 | 3/2013 | Brostow | |
| 2013/0072740 | A1 | 3/2013 | Hillman | |
| 2013/0133362 | A1 | 5/2013 | Lee | |
| 2013/0139544 | A1 | 6/2013 | Mak | |
| 2013/0213087 | A1 | 8/2013 | Currence et al. | |

FOREIGN PATENT DOCUMENTS

| | | | | |
|---|---|---|---|---|
| CN | 102748919 | A | 10/2012 | |
| DE | 19612173 | C1 | 5/1997 | |
| DE | 19937623 | A1 | 2/2001 | |
| DE | 10209799 | | 9/2003 | |
| DE | 102005053267 | A1 * | 5/2007 | F25B 1/10 |
| DE | 10194530 | | 10/2007 | |
| DE | 102010011052 | | 9/2011 | |
| DE | 102011104725 | | 12/2012 | |
| EP | 0008823 | | 3/1980 | |
| EP | 0768502 | | 4/1997 | |
| EP | 0644996 | B1 | 12/1998 | |
| EP | 0975923 | A1 | 2/2000 | |
| EP | 1016842 | A2 | 7/2000 | |
| EP | 1092930 | A1 | 4/2001 | |
| EP | 1092931 | A1 | 4/2001 | |
| EP | 1118827 | A1 | 7/2001 | |
| EP | 1144928 | A2 | 10/2001 | |
| EP | 0990108 | B1 | 9/2002 | |
| EP | 1248935 | A1 | 10/2002 | |
| EP | 1137902 | B1 | 1/2003 | |
| EP | 1273860 | A2 | 1/2003 | |
| EP | 1306632 | A1 | 5/2003 | |
| EP | 1309973 | A2 | 5/2003 | |
| EP | 1352203 | A1 | 10/2003 | |
| EP | 1397629 | A1 | 3/2004 | |
| EP | 1092932 | A1 | 12/2004 | |
| EP | 1092933 | B1 | 12/2004 | |
| EP | 1304535 | B1 | 2/2005 | |
| EP | 1455152 | B2 | 7/2005 | |
| EP | 1323994 | B1 | 10/2005 | |
| EP | 1281033 | B1 | 2/2006 | |
| EP | 1668300 | A1 | 6/2006 | |
| EP | 1774234 | | 4/2007 | |
| EP | 1790926 | A1 | 5/2007 | |
| EP | 1812760 | A2 | 8/2007 | |
| EP | 1864062 | A1 | 12/2007 | |
| EP | 1881283 | A2 | 1/2008 | |
| EP | 1929227 | A1 | 6/2008 | |
| EP | 1946026 | A2 | 7/2008 | |
| EP | 2005056 | A2 | 12/2008 | |
| EP | 2052197 | A2 | 4/2009 | |
| EP | 2074364 | A2 | 7/2009 | |
| EP | 2092257 | A2 | 8/2009 | |
| EP | 2110630 | A1 | 10/2009 | |
| EP | 1456589 | B1 | 1/2010 | |
| EP | 2165138 | A2 | 3/2010 | |
| EP | 2185877 | A1 | 5/2010 | |
| EP | 2199716 | A2 | 6/2010 | |
| EP | 2212402 | A1 | 8/2010 | |
| EP | 2229566 | A1 | 9/2010 | |
| EP | 2251625 | A2 | 11/2010 | |
| EP | 2366085 | A2 | 9/2011 | |
| EP | 2399091 | A1 | 12/2011 | |
| EP | 1613910 | B1 | 2/2012 | |
| EP | 2547972 | A1 | 1/2013 | |
| EP | 2550496 | A2 | 1/2013 | |
| EP | 2562501 | A2 | 2/2013 | |
| EP | 1613909 | B1 | 3/2013 | |
| EP | 2600088 | A2 | 6/2013 | |
| FR | 2764972 | | 12/1998 | |
| FR | 2841330 | | 12/2003 | |
| FR | 28856779 | | 11/2006 | |
| FR | 2891900 | A1 | 4/2007 | |
| GB | 1122830 | | 8/1968 | |
| GB | 2326464 | A | 12/1998 | |
| GB | 2326465 | A | 12/1998 | |

(56) References Cited

FOREIGN PATENT DOCUMENTS

| | | | |
|---|---|---|---|
| GB | 248711 | A | 7/2012 |
| JP | H8-159652 | | 6/1996 |
| JP | H9-113129 | | 5/1997 |
| JP | 2002/508055 | | 3/2002 |
| JP | 2002/532674 | | 10/2002 |
| JP | 200952876 | A | 3/2009 |
| JP | 2009544923 | A | 12/2009 |
| JP | 2011506894 | A | 3/2011 |
| WO | WO 94/24500 | | 10/1994 |
| WO | WO98/48227 | | 10/1998 |
| WO | WO00/36350 | | 6/2000 |
| WO | WO 01/39200 | A2 | 5/2001 |
| WO | WO 01/044735 | | 6/2001 |
| WO | WO 02/29337 | A1 | 4/2002 |
| WO | WO 02/050483 | A1 | 6/2002 |
| WO | WO 02/101307 | A1 | 12/2002 |
| WO | WO03/074955 | | 9/2003 |
| WO | WO 2005/028976 | A1 | 3/2005 |
| WO | WO 2006/007278 | | 1/2006 |
| WO | WO 2006/009610 | A2 | 1/2006 |
| WO | WO 2006/047098 | A2 | 5/2006 |
| WO | WO 2006/094675 | | 9/2006 |
| WO | WO 2006/120127 | A2 | 11/2006 |
| WO | WO 2007/021351 | | 2/2007 |
| WO | WO 2007/042662 | | 4/2007 |
| WO | WO 2007/120782 | A2 | 10/2007 |
| WO | 2008009721 | A2 | 1/2008 |
| WO | WO 2008/006867 | | 1/2008 |
| WO | WO 2008/020044 | A2 | 2/2008 |
| WO | WO 2008/034875 | | 3/2008 |
| WO | WO 2008/074718 | A2 | 6/2008 |
| WO | WO 2009/007435 | A2 | 1/2009 |
| WO | WO 2009/050178 | A2 | 4/2009 |
| WO | WO 2009/029140 | A1 | 5/2009 |
| WO | WO 2009/061777 | A1 | 5/2009 |
| WO | 2009072900 | A1 | 6/2009 |
| WO | WO 2009/085937 | | 7/2009 |
| WO | WO 2010/0582772 | A2 | 5/2010 |
| WO | WO 2010/096305 | A1 | 8/2010 |
| WO | WO 2010/133482 | A2 | 11/2010 |
| WO | WO 2011/115760 | | 9/2011 |
| WO | WO 2011/117655 | | 9/2011 |
| WO | WO 2012/023752 | A2 | 2/2012 |
| WO | WO 2012/075266 | A2 | 6/2012 |
| WO | WO 2012/112692 | A1 | 8/2012 |
| WO | WO 2012/167007 | A1 | 12/2012 |
| WO | WO 2013/055305 | A1 | 4/2013 |
| WO | WO 2013/081979 | A1 | 6/2013 |
| WO | WO 2013/087570 | A2 | 6/2013 |
| WO | WO 2013/087571 | A2 | 6/2013 |
| WO | WO 2014/116363 | A1 | 7/2014 |

OTHER PUBLICATIONS

English translation of DE 102005053267 A1 provided by Espacenet. Sep. 2018.q.*

International Search Report and Written Opinion from PCT/US2014/031135 dated Aug. 19, 2014.

International Preliminary Report on Patentability from PCT/US2014/031135 dated Mar. 9, 2015.

International Search Report and Written Opinion issued in International Application No. PCT/US2011/027162 dated May 3, 2011.

International Preliminary Report on Patentability International Application No. PCT/US2011/027162 dated Sep. 18, 2012.

Supplementary European Search Report issued in EP11756720 dated Jun. 1, 2015.

International Search Report and Written Opinion of the International Searching Authority, PCT/US2016/026924, dated Aug. 19, 2016.

International Search Report and Written Opinion of the International Searching Authority for PCT/US2014/031135 dated Aug. 19, 2014.

Office Action issued in Mexican Application No. MX/a/2012/010726 dated Mar. 12, 2015 with English translation.

Extended European Search Report dated Jun. 19, 2017, for European Application No. EP 14762447.2 from the European Patent Office.

Notification of Reasons for Rejection from the Third Examination Department of the Japanese Patent Office for Japanese Patent Appl. No. 2016-502613 dated Jun. 20, 2018, with English Translation.

* cited by examiner

| Stream Name | | FEED | PRODUCT | 14 | 18 | 22 | 24 |
|---|---|---|---|---|---|---|---|
| Stream Description | | Feed Gas | LNG | 1st Stage Inlet | 1st Stage Discharge | Interstage Drum Inlet | 2nd Stage Inlet |
| | | | | | | | |
| Phase | | Vapor | Liquid | Vapor | Vapor | Mixed | Vapor |
| | | | | | | | |
| Temperature | C | 34.59 | -163.00 | 9.38 | 80.42 | 35.00 | 34.77 |
| Pressure | BAR | 54.01 | 53.61 | 4.40 | 16.99 | 16.51 | 16.51 |
| | | | | | | | |
| Flowrate | KG-MOL/HR | 1,003.3 | 1,003.3 | 3,429.2 | 3,429.2 | 3,429.2 | 2,913.2 |
| Total Mass Rate | KG/HR | 16,356.5 | 16,356.5 | 124,209.4 | 124,209.4 | 124,209.4 | 96,868.1 |
| Total Molecular Weight | | 16.30 | 16.30 | 36.22 | 36.22 | 36.22 | 33.25 |
| | | | | | | | |
| Composition | Mole% | | | | | | |
| N2 | | 1.00 | 1.00 | 6.31 | 6.31 | 6.31 | 7.38 |
| METHANE | | 98.00 | 98.00 | 19.32 | 19.32 | 19.32 | 22.41 |
| C2H4 | | 0.00 | 0.00 | 33.83 | 33.83 | 33.83 | 38.49 |
| ETHANE | | 1.00 | 1.00 | 0.00 | 0.00 | 0.00 | 0.00 |
| C3 | | 0.00 | 0.00 | 12.14 | 12.14 | 12.14 | 11.74 |
| BUTANE | | 0.00 | 0.00 | 28.41 | 28.41 | 28.41 | 19.98 |
| **High/Low Ranges** | | | | | | | |
| High Temperature | C | 50.00 | -140.00 | 50.00 | | 50.00 | |
| Low Temperature | C | -40.00 | -165.00 | -60.00 | | -40.00 | |
| High Pressure | BAR | 72.00 | 72.00 | 12.00 | | 25.00 | |
| Low Pressure | BAR | 20.00 | 20.00 | 2.00 | | 8.00 | |

FIG. 13A

| Stream Name | | 28 | 32 | 34 | 36 | 38 |
|---|---|---|---|---|---|---|
| Stream Description | | 2nd Stage Discharge | Accumulator Inlet | Accumulator Vapor | Accumulator Liquid | Mid Boiling Refrigerant Inlet |
| | | | | | | |
| Phase | | Vapor | Mixed | Vapor | Liquid | Liquid |
| | | | | | | |
| Temperature | C | 68.16 | 35.00 | 35.00 | 35.00 | 35.00 |
| Pressure | BAR | 27.88 | 27.40 | 27.40 | 27.40 | 27.40 |
| | | | | | | |
| Flowrate | KG-MOL/HR | 2,913.2 | 2,913.2 | 2,474.4 | 438.8 | 351.0 |
| Total Mass Rate | KG/HR | 96,868.1 | 96,868.1 | 75,527.5 | 21,340.6 | 17,072.5 |
| Total Molecular Weight | | 33.25 | 33.25 | 30.52 | 48.64 | 48.64 |
| | | | | | | |
| Composition | Mole% | | | | | |
| N2 | | 7.38 | 7.38 | 8.58 | 0.60 | 0.60 |
| METHANE | | 22.41 | 22.41 | 25.60 | 4.42 | 4.42 |
| C2H4 | | 38.49 | 38.49 | 42.49 | 15.94 | 15.94 |
| ETHANE | | 0.00 | 0.00 | 0.00 | 0.00 | 0.00 |
| C3 | | 11.74 | 11.74 | 10.47 | 18.92 | 18.92 |
| BUTANE | | 19.98 | 19.98 | 12.86 | 60.12 | 60.12 |
| **High/Low Ranges** | | | | | | |
| High Temperature | C | 130.00 | 50.00 | | | |
| Low Temperature | C | 40.00 | -40.00 | | | |
| High Pressure | BAR | 72.00 | 72.00 | | | |
| Low Pressure | BAR | 22.00 | 22.00 | | | |

FIG. 13B

| Stream Name | | 40 | 48 | 104A | 108A | 112 |
|---|---|---|---|---|---|---|
| Stream Description | | Spillback | High Boiling Refrigerant Inlet | Low Pressure MR Vapor Outlet | Low Pressure High Boiling Refrigerant Outlet | Subcooled Cold Separator Vapor |
| | | | | | | |
| Phase | | Liquid | Liquid | Vapor | Mixed | Liquid |
| | | | | | | |
| Temperature | C | 35.00 | 34.77 | 31.88 | 31.88 | -163.00 |
| Pressure | BAR | 27.40 | 16.51 | 4.50 | 4.50 | 27.20 |
| | | | | | | |
| Flowrate | KG-MOL/HR | 87.8 | 603.8 | 2,825.4 | 603.8 | 998.7 |
| Total Mass Rate | KG/HR | 4,268.1 | 31,609.4 | 92,600.0 | 31,609.4 | 23,176.3 |
| Total Molecular Weight | | 48.64 | 52.35 | 32.77 | 52.35 | 23.21 |
| | | | | | | |
| Composition | Mole% | | | | | |
| N2 | | 0.60 | 0.28 | 7.59 | 0.28 | 18.95 |
| METHANE | | 4.42 | 2.26 | 22.96 | 2.26 | 43.53 |
| C2H4 | | 15.94 | 8.72 | 39.19 | 8.72 | 35.60 |
| ETHANE | | 0.00 | 0.00 | 0.00 | 0.00 | 0.00 |
| C3 | | 18.92 | 15.05 | 11.52 | 15.05 | 1.35 |
| BUTANE | | 60.12 | 73.68 | 18.73 | 73.68 | 0.57 |
| **High/Low Ranges** | | | | | | |
| High Temperature | C | | | | | -140.00 |
| Low Temperature | C | | | | | -170.00 |
| High Pressure | BAR | | | | | 72.00 |
| Low Pressure | BAR | | | | | 22.00 |

FIG. 13C

| Stream Name | | 122 | 124 | 128 | 132 | 140 |
|---|---|---|---|---|---|---|
| Stream Description | | Low Pressure MR Vapor Inlet | Subcooled Mid Boiling Refrigerant | Subcooled Cold Separator Vapor | Low Pressure High Boiling Re-frigerant Outlet | Subcooled Mid Boiling Refrigerant |
| | | | | | | |
| Phase | | Mixed | Liquid | Liquid | Liquid | Liquid |
| | | | | | | |
| Temperature | C | -166.52 | -95.00 | -91.58 | -93.97 | -65.00 |
| Pressure | BAR | 4.80 | 27.20 | 27.20 | 4.70 | 16.31 |
| | | | | | | |
| Flowrate | KG-MOL/HR | 998.7 | 351.0 | 1,475.7 | 351.0 | 603.8 |
| Total Mass Rate | KG/HR | 23,176.3 | 17,072.5 | 52,351.2 | 17,072.5 | 31,609.4 |
| Total Molecular Weight | | 23.21 | 48.64 | 35.47 | 48.64 | 52.35 |
| | | | | | | |
| Composition | Mole% | | | | | |
| N2 | | 18.95 | 0.60 | 1.57 | 0.60 | 0.28 |
| METHANE | | 43.53 | 4.42 | 13.46 | 4.42 | 2.26 |
| C2H4 | | 35.60 | 15.94 | 47.15 | 15.94 | 8.72 |
| ETHANE | | 0.00 | 0.00 | 0.00 | 0.00 | 0.00 |
| C3 | | 1.35 | 18.92 | 16.64 | 18.92 | 15.05 |
| BUTANE | | 0.57 | 60.12 | 21.18 | 60.12 | 73.68 |
| **High/Low Ranges** | | | | | | |
| High Temperature | C | -145.00 | -50.00 | -50.00 | -55.00 | -20.00 |
| Low Temperature | C | -175.00 | -135.00 | -135.00 | -140.00 | -90.00 |
| High Pressure | BAR | 12.00 | 72.00 | 72.00 | 12.00 | 25.00 |
| Low Pressure | BAR | 2.00 | 22.00 | 22.00 | 2.00 | 8.00 |

FIG. 13D

| Stream Name | | 158 | 156 | 160 | 164 |
|---|---|---|---|---|---|
| Stream Description | | Low Pressure High Boiling Refrigerant Inlet | Cold Separator Liquid | Cold Separator Vapor | Cold Separator Feed |
| | | | | | |
| Phase | | Liquid | Liquid | Vapor | Mixed |
| | | | | | |
| Temperature | C | -64.49 | -39.00 | -39.00 | -39.00 |
| Pressure | BAR | 4.70 | 27.20 | 27.20 | 27.20 |
| | | | | | |
| Flowrate | KG-MOL/HR | 603.8 | 1,475.7 | 998.7 | 2,474.4 |
| Total Mass Rate | KG/HR | 31,609.4 | 52,351.2 | 23,176.3 | 75,527.5 |
| Total Molecular Weight | | 52.35 | 35.47 | 23.21 | 30.52 |
| | | | | | |
| Composition | Mole% | | | | |
| N2 | | 0.28 | 1.57 | 18.95 | 8.58 |
| METHANE | | 2.26 | 13.46 | 43.53 | 25.60 |
| C2H4 | | 8.72 | 47.15 | 35.60 | 42.49 |
| ETHANE | | 0.00 | 0.00 | 0.00 | 0.00 |
| C3 | | 15.05 | 16.64 | 1.35 | 10.47 |
| BUTANE | | 73.68 | 21.18 | 1.57 | 12.86 |
| **High/Low Ranges** | | | | | |
| High Temperature | C | -25.00 | | | -20.00 |
| Low Temperature | C | -95.00 | | | -80.00 |
| High Pressure | BAR | 12.00 | | | 72.00 |
| Low Pressure | BAR | 2.00 | | | 22.00 |

FIG. 13E

| Stream Name | | FEED | PRODUCT | 14 | 14L | 18 | 18L |
|---|---|---|---|---|---|---|---|
| Stream Description | | Feed Gas | LNG | 1st Stage Inlet | MP Pump Inlet | 1st Stage Discharge | MP Pump Discharge |
| | | | | | | | |
| Phase | | Vapor | Liquid | Vapor | Liquid | Vapor | Liquid |
| | | | | | | | |
| Temperature | C | 34.59 | -163.00 | 8.00 | 7.12 | 78.07 | 8.10 |
| Pressure | BAR | 54.01 | 53.61 | 4.40 | 4.40 | 16.99 | 16.99 |
| | | | | | | | |
| Flowrate | KG-MOL/HR | 1,003.3 | 1,003.3 | 3,503.5 | 59.4 | 3,503.5 | 59.4 |
| Total Mass Rate | KG/HR | 16,356.5 | 16,356.5 | 128,829.6 | 3,313.3 | 128,829.6 | 3,313.3 |
| Total Molecular Weight | | 16.30 | 16.30 | 36.77 | 55.79 | 36.77 | 55.79 |
| | | | | | | | |
| Composition | Mole% | | | | | | |
| N2 | | 1.00 | 1.00 | 6.17 | 0.00 | 6.17 | 0.00 |
| METHANE | | 98.00 | 98.00 | 18.83 | 0.01 | 18.83 | 0.01 |
| C2H4 | | 0.00 | 0.00 | 32.96 | 0.03 | 32.96 | 0.03 |
| ETHANE | | 1.00 | 1.00 | 0.00 | 0.00 | 0.00 | 0.00 |
| C3 | | 0.00 | 0.00 | 11.83 | 0.09 | 11.83 | 0.09 |
| BUTANE | | 0.00 | 0.00 | 30.21 | 0.88 | 30.21 | 0.88 |
| **High/Low Ranges** | | | | | | | |
| High Temperature | C | 50.00 | -140.00 | 50.00 | 50.00 | | |
| Low Temperature | C | -40.00 | -165.00 | -60.00 | -60.00 | | |
| High Pressure | BAR | 72.00 | 72.00 | 12.00 | 12.00 | | |
| Low Pressure | BAR | 20.00 | 20.00 | 2.00 | 2.00 | | |

FIG. 14A

| Stream Name | | 22 | 24 | 28 | 32 | 34 |
|---|---|---|---|---|---|---|
| Stream Description | | Interstage Drum Inlet | 2nd Stage Inlet | 2nd Stage Discharge | Accumulator Inlet | Accumulator Vapor |
| | | | | | | |
| Phase | | Mixed | Vapor | Vapor | Mixed | Vapor |
| | | | | | | |
| Temperature | C | 35.00 | 34.79 | 68.20 | 35.00 | 35.00 |
| Pressure | BAR | 16.51 | 16.51 | 27.88 | 27.40 | 27.40 |
| | | | | | | |
| Flowrate | KG-MOL/HR | 3,503.5 | 2,870.5 | 2,870.5 | 2,870.5 | 2,442.0 |
| Total Mass Rate | KG/HR | 128,829.6 | 95,329.7 | 95,329.7 | 95,329.7 | 74,449.1 |
| Total Molecular Weight | | 36.77 | 33.21 | 33.21 | 33.21 | 30.49 |
| | | | | | | |
| Composition | Mole% | | | | | |
| N2 | | 6.17 | 7.48 | 7.48 | 7.48 | 8.68 |
| METHANE | | 18.83 | 22.54 | 22.54 | 22.54 | 25.72 |
| C2H4 | | 32.96 | 38.53 | 38.53 | 38.53 | 42.50 |
| ETHANE | | 0.00 | 0.00 | 0.00 | 0.00 | 0.00 |
| C3 | | 11.83 | 11.35 | 11.35 | 11.35 | 10.13 |
| BUTANE | | 30.21 | 20.11 | 20.11 | 20.11 | 12.97 |
| **High/Low Ranges** | | | | | | |
| High Temperature | C | 50.00 | | 130.00 | 50.00 | |
| Low Temperature | C | -40.00 | | 40.00 | -40.00 | |
| High Pressure | BAR | 25.00 | | 72.00 | 72.00 | |
| Low Pressure | BAR | 8.00 | | 22.00 | 22.00 | |

FIG. 14B

| Stream Name | | 36 | 38 | 40 | 48 | 104A |
|---|---|---|---|---|---|---|
| Stream Description | | Accumulator Liquid | Mid Boiling Refrigerant Inlet | Spillback | High Boiling Refrigerant Inlet | Low Pressure MR Vapor Outlet |
| | | | | | | |
| Phase | | Liquid | Liquid | Liquid | Liquid | Vapor |
| | | | | | | |
| Temperature | C | 35.00 | 35.00 | 35.00 | 34.79 | 31.01 |
| Pressure | BAR | 27.40 | 27.40 | 27.40 | 16.51 | 4.50 |
| | | | | | | |
| Flowrate | KG-MOL/HR | 428.5 | 342.8 | 85.7 | 718.7 | 2,784.8 |
| Total Mass Rate | KG/HR | 20 ,880.6 | 16,704.5 | 4,176.1 | 37,676.0 | 91,153.6 |
| Total Molecular Weight | | 48.73 | 48.73 | 48.73 | 52.42 | 32.73 |
| | | | | | | |
| Composition | Mole% | | | | | |
| N2 | | 0.60 | 0.60 | 0.60 | 0.28 | 7.69 |
| METHANE | | 4.43 | 4.43 | 4.43 | 2.27 | 23.10 |
| C2H4 | | 15.89 | 15.89 | 15.89 | 8.71 | 39.22 |
| ETHANE | | 0.00 | 0.00 | 0.00 | 0.00 | 0.00 |
| C3 | | 18.31 | 18.31 | 18.31 | 14.54 | 11.13 |
| BUTANE | | 60.77 | 60.77 | 60.77 | 74.19 | 18.86 |
| **High/Low Ranges** | | | | | | |
| High Temperature | C | | | | | |
| Low Temperature | C | | | | | |
| High Pressure | BAR | | | | | |
| Low Pressure | BAR | | | | | |

FIG. 14C

| Stream Name | | 108A | 112 | 122 | 124 | 128 |
|---|---|---|---|---|---|---|
| Stream Description | | Low Pressure High Boiling Refrigerant Outlet | Subcooled Cold Separator Vapor | Low Pressure MR Inlet | Subcooled Mid Boiling Refrigerant | Subcooled Cold Separator Liquid |
| | | | | | | |
| Phase | | Mixed | Liquid | Mixed | Liquid | Liquid |
| | | | | | | |
| Temperature | C | 31.01 | -163.00 | -166.52 | -95.00 | -91.72 |
| Pressure | BAR | 4.50 | 27.20 | 4.80 | 27.20 | 27.20 |
| | | | | | | |
| Flowrate | KG-MOL/HR | 718.7 | 999.6 | 999.6 | 342.8 | 1,442.5 |
| Total Mass Rate | KG/HR | 37,676.0 | 23,204.5 | 23,204.5 | 16,704.5 | 51,244.6 |
| Total Molecular Weight | | 52.42 | 23.21 | 23.21 | 48.73 | 35.53 |
| | | | | | | |
| Composition | Mole% | | | | | |
| N2 | | 0.28 | 18.94 | 18.94 | 0.60 | 1.57 |
| METHANE | | 2.27 | 43.44 | 43.44 | 4.43 | 13.44 |
| C2H4 | | 8.71 | 35.72 | 35.72 | 15.89 | 47.20 |
| ETHANE | | 0.00 | 0.00 | 0.00 | 0.00 | 0.00 |
| C3 | | 14.54 | 1.32 | 1.32 | 18.31 | 16.23 |
| BUTANE | | 74.19 | 0.58 | 0.58 | 60.77 | 21.56 |
| **High/Low Ranges** | | | | | | |
| High Temperature | C | | -140.00 | -145.00 | -50.00 | -50.00 |
| Low Temperature | C | | -170.00 | -175.00 | -135.00 | -135.00 |
| High Pressure | BAR | | 72.00 | 12.00 | 72.00 | 72.00 |
| Low Pressure | BAR | | 22.00 | 2.00 | 22.00 | 22.00 |

FIG. 14D

| Stream Name | | 132 | 140 | 158 | 156 |
|---|---|---|---|---|---|
| Stream Description | | Low Pressure Mid Boiling Refrigerant Inlet | Subcooled High Boiling Refrigerant | Low Pressure High Boiling Refrigerant Outlet | Cold Separator Liquid |
| | | | | | |
| Phase | | Liquid | Liquid | Liquid | Liquid |
| | | | | | |
| Temperature | C | -93.97 | -65.00 | -64.49 | -39.00 |
| Pressure | BAR | 4.70 | 16.31 | 4.70 | 27.20 |
| | | | | | |
| Flowrate | KG-MOL/HR | 342.8 | 718.7 | 718.7 | 1,442.5 |
| Total Mass Rate | KG/HR | 16,704.5 | 37,676.0 | 37,676.0 | 51,244.6 |
| Total Molecular Weight | | 48.73 | 52.42 | 52.42 | 35.53 |
| | | | | | |
| Composition | Mole% | | | | |
| N2 | | 0.60 | 0.28 | 0.28 | 1.57 |
| METHANE | | 4.43 | 2.27 | 2.27 | 13.44 |
| C2H4 | | 15.89 | 8.71 | 8.71 | 47.20 |
| ETHANE | | 0.00 | 0.00 | 0.00 | 0.00 |
| C3 | | 18.31 | 14.54 | 14.54 | 16.23 |
| BUTANE | | 60.77 | 74.19 | 74.19 | 21.56 |
| **High/Low Ranges** | | | | | |
| High Temperature | C | -55.00 | -20.00 | -25.00 | |
| Low Temperature | C | -140.00 | -90.00 | -95.00 | |
| High Pressure | BAR | 12.00 | 25.00 | 12.00 | |
| Low Pressure | BAR | 2.00 | 8.00 | 2.00 | |

FIG. 14E

| Stream Name | | 160 | 164 |
|---|---|---|---|
| Stream Description | | Cold Separator Vapor | Cold Separator Feed |
| | | | |
| Phase | | Vapor | Mixed |
| | | | |
| Temperature | C | -39.00 | -39.00 |
| Pressure | BAR | 27.20 | 27.20 |
| | | | |
| Flowrate | KG-MOL/HR | 999.6 | 2,442.0 |
| Total Mass Rate | KG/HR | 23,204.5 | 74,449.1 |
| Total Molecular Weight | | 23.21 | 30.49 |
| | | | |
| Composition | Mole% | | |
| N2 | | 18.94 | 8.68 |
| METHANE | | 43.44 | 25.72 |
| C2H4 | | 35.72 | 42.50 |
| ETHANE | | 0.00 | 0.00 |
| C3 | | 1.32 | 10.13 |
| BUTANE | | 0.58 | 12.97 |
| **High/Low Ranges** | | | |
| High Temperature | C | | -20.00 |
| Low Temperature | C | | -80.00 |
| High Pressure | BAR | | 72.00 |
| Low Pressure | BAR | | 22.00 |

FIG. 14F

MIXED REFRIGERANT SYSTEM AND METHOD

RELATED APPLICATIONS

This application claims priority to U.S. Provisional Application 61/802,350 filed Mar. 15, 2013, the entire contents of which are hereby incorporated by reference.

FIELD OF THE INVENTION

The present invention generally relates to mixed refrigerant systems and methods suitable for cooling fluids such as natural gas.

BACKGROUND

Natural gas and other gases are liquefied for storage and transport. Liquefaction reduces the volume of the gas and is typically carried out by chilling the gas through indirect heat exchange in one or more refrigeration cycles. The refrigeration cycles are costly because of the complexity of the equipment and the performance efficiency of the cycle. There is a need, therefore, for gas cooling and/or liquefaction systems that are less complex, more efficient, and less expensive to operate.

Liquefying natural gas, which is primarily methane, typically requires cooling the gas stream to approximately −160° C. to −170° C. and then letting down the pressure to approximately atmospheric. Typical temperature-enthalpy curves for liquefying gaseous methane, such as shown in FIG. 1 (methane at 60 bar pressure, methane at 35 bar pressure, and a methane/ethane mixture at 35 bar pressure), have three regions along an S-shaped curve. As the gas is cooled, at temperatures above about −75° C. the gas is de-superheating; and at temperatures below about −90° C. the liquid is subcooling. Between these temperatures, a relatively flat region is observed—in which the gas is condensing into liquid. In the 60 bar methane curve, because the gas is above the critical pressure, only one phase is present above the critical temperature, but its specific heat is large near the critical temperature; below the critical temperature the cooling curve is similar to the lower pressure (35 bar) curves. The 35 bar curve for 95% methane/5% ethane shows the effect of impurities, which round off the dew and bubble points.

Refrigeration processes supply the requisite cooling for liquefying natural gas, and the most efficient of these have heating curves that closely approach the cooling curves in FIG. 1, ideally to within a few degrees throughout the entire temperature range. However, because of the S-shaped form of the cooling curves and the large temperature range, such refrigeration processes are difficult to design. Pure component refrigerant processes, because of their flat vaporization curves, work best in the two-phase region. Multi-component refrigerant processes, on the other hand, have sloping vaporization curves and are more appropriate for the de-superheating and subcooling regions. Both types of processes, and hybrids of the two, have been developed for liquefying natural gas.

Cascaded, multilevel, pure component refrigeration cycles were initially used with refrigerants such as propylene, ethylene, methane, and nitrogen. With enough levels, such cycles can generate a net heating curve that approximates the cooling curves shown in FIG. 1. However, as the number of levels increases, additional compressor trains are required, which undesirably adds to the mechanical complexity. Further, such processes are thermodynamically inefficient because the pure component refrigerants vaporize at constant temperature instead of following the natural gas cooling curve, and the refrigeration valve irreversibly flashes the liquid into vapor. For these reasons, mixed refrigerant processes have become popular to reduce capital costs and energy consumption and to improve operability.

U.S. Pat. No. 5,746,066 to Manley describes a cascaded, multilevel, mixed refrigerant process for ethylene recovery, which eliminates the thermodynamic inefficiencies of the cascaded multilevel pure component process. This is because the refrigerants vaporize at rising temperatures following the gas cooling curve, and the liquid refrigerant is subcooled before flashing thus reducing thermodynamic irreversibility. Mechanical complexity is somewhat reduced because fewer refrigerant cycles are required compared to pure refrigerant processes. See, e.g., U.S. Pat. No. 4,525,185 to Newton; U.S. Pat. No. 4,545,795 to Liu et al.; U.S. Pat. No. 4,689,063 to Paradowski et al.; and U.S. Pat. No. 6,041,619 to Fischer et al.; and U.S. Patent Application Publication Nos. 2007/0227185 to Stone et al. and 2007/0283718 to Hulsey et al.

The cascaded, multilevel, mixed refrigerant process is among the most efficient known, but a simpler, more efficient process, which can be more easily operated, is desirable.

A single mixed refrigerant process, which requires only one compressor for refrigeration and which further reduces the mechanical complexity has been developed. See, e.g., U.S. Pat. No. 4,033,735 to Swenson. However, for primarily two reasons, this process consumes somewhat more power than the cascaded, multilevel, mixed refrigerant processes discussed above.

First, it is difficult, if not impossible, to find a single mixed refrigerant composition that generates a net heating curve that closely approximates the typical natural gas cooling curve. Such a refrigerant requires a range of relatively high and low boiling components, whose boiling temperatures are thermodynamically constrained by the phase equilibrium. Higher boiling components are further limited in order to avoid their freezing out at low temperatures. The undesirable result is that relatively large temperature differences necessarily occur at several points in the cooling process, which is inefficient in the context of power consumption.

Second, in single mixed refrigerant processes, all of the refrigerant components are carried to the lowest temperature even though the higher boiling components provide refrigeration only at the warmer end of the process. The undesirable result is that energy must be expended to cool and reheat those components that are "inert" at the lower temperatures. This is not the case with either the cascaded, multilevel, pure component refrigeration process or the cascaded, multilevel, mixed refrigerant process.

To mitigate this second inefficiency and also address the first, numerous solutions have been developed that separate a heavier fraction from a single mixed refrigerant, use the heavier fraction at the higher temperature levels of refrigeration, and then recombine the heavier fraction with the lighter fraction for subsequent compression. See, e.g., U.S. Pat. No. 2,041,725 to Podbielniak; U.S. Pat. No. 3,364,685 to Perret; U.S. Pat. No. 4,057,972 to Sarsten; U.S. Pat. No. 4,274,849 to Garner et al.; U.S. Pat. No. 4,901,533 to Fan et al.; U.S. Pat. No. 5,644,931 to Ueno et al.; U.S. Pat. No. 5,813,250 to Ueno et al; U.S. Pat. No. 6,065,305 to Arman et al.; and U.S. Pat. No. 6,347,531 to Roberts et al.; and U.S. Patent Application Publication No. 2009/0205366 to Schmidt With careful design, these processes can improve energy efficiency even though the recombining of streams not at equilibrium is thermodynamically inefficient. This is because the light and heavy fractions are separated at high pressure and then recombined at low pressure so that they may be compressed together in a single compressor. Generally, when streams are separated at equilibrium, separately processed, and then recombined at non-equilibrium conditions, a thermodynamic loss occurs, which ultimately increases power consumption. Therefore the number of such separations should be minimized. All of these processes use simple vapor/liquid equilibrium at various places in the refrigeration process to separate a heavier fraction from a lighter one.

Simple one-stage vapor/liquid equilibrium separation, however, doesn't concentrate the fractions as much as using multiple equilibrium stages with reflux. Greater concentration allows greater precision in isolating a composition that provides refrigeration over a specific range of temperatures. This enhances the process ability to follow the typical gas cooling curves. U.S. Pat. No. 4,586,942 to Gauthier and U.S. Pat. No. 6,334,334 to Stockmann et al. (the latter marketed by Linde as the LIMUM® 3 process) describe how fractionation may be employed in the above ambient compressor train to further concentrate the separated fractions used for refrigeration in different temperature zones and thus improve the overall process thermodynamic efficiency. A second reason for concentrating the fractions and reducing their temperature range of vaporization is to ensure that they are completely vaporized when they leave the refrigerated part of the process. This fully utilizes the latent heat of the refrigerant and precludes the entrainment of liquids into downstream compressors. For this same reason heavy fraction liquids are normally re-injected into the lighter fraction of the refrigerant as part of the process. Fractionation of the heavy fractions reduces flashing upon re-injection and improves the mechanical distribution of the two phase fluids.

As illustrated by U.S. Patent Application Publication No. 2007/0227185 to Stone et al., it is known to remove partially vaporized refrigeration streams from the refrigerated portion of the process. Stone et al. does this for mechanical (and not thermodynamic) reasons and in the context of a cascaded, multilevel, mixed refrigerant process that requires two separate mixed refrigerants. The partially vaporized refrigeration streams are completely vaporized upon recombination with their previously separated vapor fractions immediately prior to compression.

Multi-stream, mixed refrigerant systems are known in which simple equilibrium separation of a heavy fraction was found to significantly improve the mixed refrigerant process efficiency if that heavy fraction isn't entirely vaporized as it leaves the primary heat exchanger. See, e.g., U.S. Patent Application Publication No. 2011/0226008 to Gushanas et al. Liquid refrigerant, if present at the compressor suction, must be separated beforehand and sometimes pumped to a higher pressure. When the liquid refrigerant is mixed with the vaporized lighter fraction of the refrigerant, the compressor suction gas is cooled, which further reduces the power required. Heavy components of the refrigerant are kept out of the cold end of the heat exchanger, which reduces the possibility of refrigerant freezing. Also, equilibrium separation of the heavy fraction during an intermediate stage reduces the load on the second or higher stage compressor(s), which improves process efficiency. Use of the heavy fraction in an independent pre-cool refrigeration loop can result in a near closure of the heating/cooling curves at the warm end of the heat exchanger, which results in more efficient refrigeration.

"Cold vapor" separation has been used to fractionate high pressure vapor into liquid and vapor streams. See, e.g., U.S. Pat. No. 6,334,334 to Stockmann et al., discussed above; "State of the Art LNG Technology in China", Lange, M., 5$^{th}$ Asia LNG Summit, Oct. 14, 2010; "Cryogenic Mixed Refrigerant Processes", International Cryogenics Monograph Series, Venkatarathnam, G., Springer, pp 199-205; and "Efficiency of Mid Scale LNG Processes Under Different Operating Conditions", Bauer, H., Linde Engineering. In another process, marketed by Air Products as the AP-SMR™ LNG process, a "warm", mixed refrigerant vapor is separated into cold mixed refrigerant liquid and vapor streams. See, e.g., "Innovations in Natural Gas Liquefaction Technology for Future LNG Plants and Floating LNG Facilities", International Gas Union Research Conference 2011, Bukowski, J. et al. In these processes, the thus-separated cold liquid is used as the middle temperature refrigerant by itself and remains separate from the thus-separated cold vapor prior to joining a common return stream. The cold liquid and vapor streams, together with the rest of the returning refrigerants, are recombined via cascade and exit together from the bottom of the heat exchanger.

In the vapor separation systems discussed above, the warm temperature refrigeration used to partially condense the liquid in the cold vapor separator is produced by the liquid from the high-pressure accumulator. The present inventors have found that this requires higher pressure and less than ideal temperatures, both of which undesirably consume more power during operation.

Another process that uses cold vapor separation, albeit in a multi-stage, mixed refrigerant system, is described in GB Pat. No. 2,326,464 to Costain Oil. In this system, vapor from a separate reflux heat exchanger is partially condensed and separated into liquid and vapor streams. The thus-separated liquid and vapor streams are cooled and separately flashed before rejoining in a low-pressure return stream. Then, before exiting the main heat exchanger, the low-pressure return stream is combined with a subcooled and flashed liquid from the aforementioned reflux heat exchanger and then further combined with a subcooled and flashed liquid provided by a separation drum set between the compressor stages. In this system, the "cold vapor" separated liquid and the liquid from the aforementioned reflux heat exchanger are not combined prior to joining the low-pressure return stream. That is, they remain separate before independently joining up with the low-pressure return stream. As will be explained more fully below, the present inventors have found that power consumption can be significantly reduced by, inter alia, mixing a liquid obtained from a high-pressure accumulator with the cold vapor separated liquid prior to their joining a return stream.

BRIEF DESCRIPTION OF THE DRAWINGS

FIGS. 13A-13E show stream data for several embodiments of the invention and correlate with FIG. 6.

FIGS. 14A-14F show stream data for several embodiments of the invention and correlate with FIG. 7.

BRIEF SUMMARY

Figure 1:
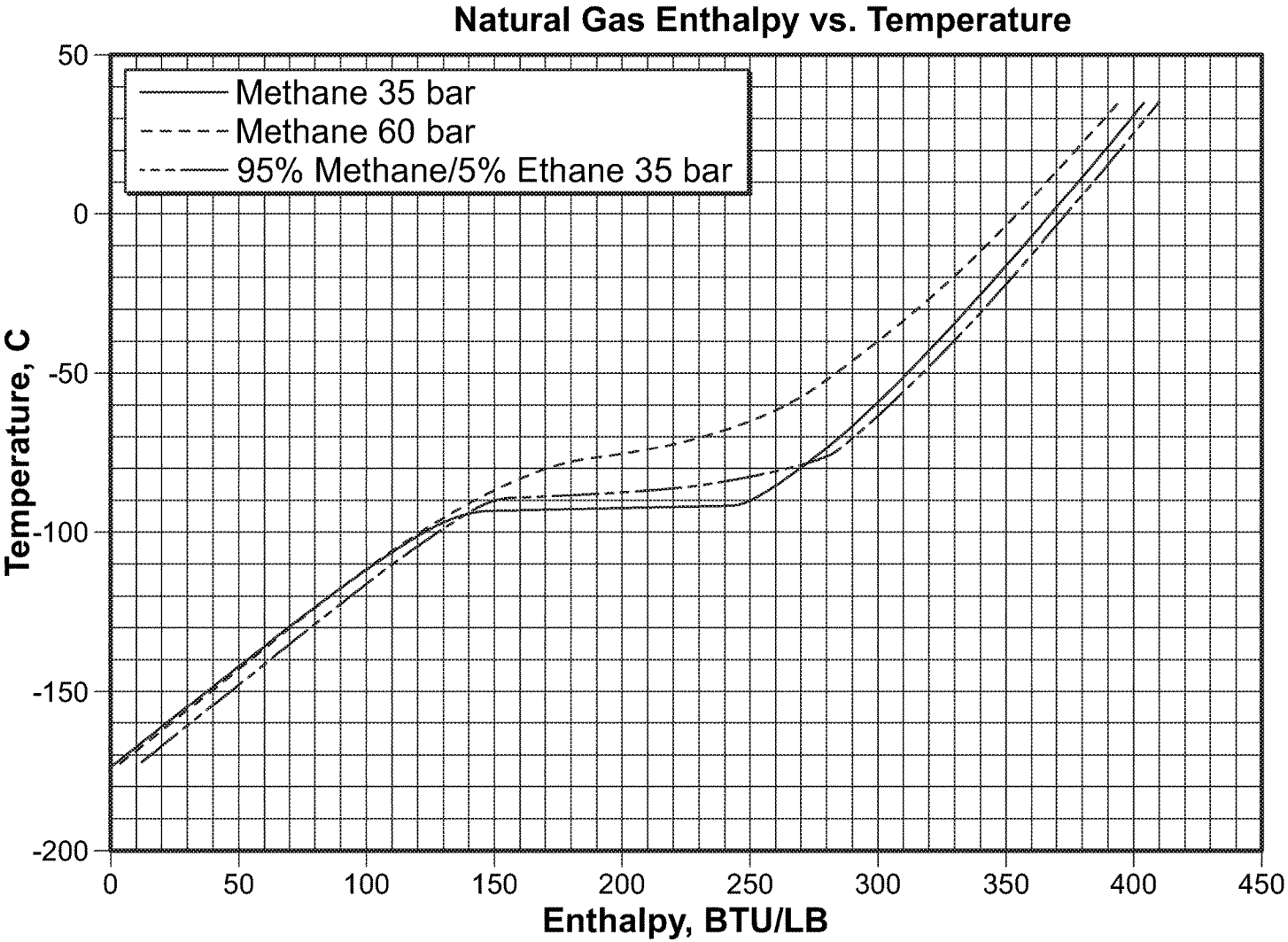
FIG. 1 is a graphical representation of temperature-enthalpy curves for methane and a methane-ethane mixture.

In accordance with embodiments described herein, cold vapor separation is used to fractionate condensed vapor obtained from high pressure separation into a cold liquid fraction and a cold vapor fraction. The cold vapor fraction may be used as the cold temperature refrigerant, but efficiencies can be obtained when the cold liquid fraction is combined with liquid obtained from the high pressure accumulator separation, and the resulting combination is used as the middle temperature refrigerant.

In embodiments herein, the middle temperature refrigerant, formed from the cold separator liquid and the high pressure accumulator liquid, provides the appropriate temperature and quantity to substantially condense the feed gas—in the case of natural gas—into liquid natural gas (LNG) at approximately the point where the middle temperature refrigerant is introduced into the primary refrigeration passage. The cold temperature refrigerant, on the other hand, produced from cold separator vapor, may then be used to subcool the thus-condensed LNG to the final temperature desired. The inventors have found that, surprisingly, such a process can reduce power consumption by as much as 10%, and with minimal additional capital cost.

In embodiments herein, a heat exchange system and process for cooling gases such as LNG may be operated substantially at the dew point of the returning refrigerant. With the system and process, considerable savings are achieved because the pumping otherwise required on the compression side to circulate liquid refrigerant is avoided or minimized. While it may be desirable to operate a heat exchange system at the dew point of a returning refrigerant, heretofore it has been difficult to do so efficiently in practice.

In embodiments herein, a significant part of the warm temperature refrigeration used to partially condense the liquid in the cold vapor separator is produced by intermediate stage separation and not by final or high pressure separation. The inventors have found that the use of interstage separation liquid rather than high pressure accumulation liquid to provide warm temperature refrigeration reduces power consumption because the interstage separation liquid is produced at a lower pressure; and further that the interstage separation liquid operates at ideal temperatures for partially condensing the vapor obtained from high pressure separation.

An additional advantage, as in embodiments herein, is that equilibrium separation of the heavy fraction during interstage separation also reduces the load on the second or higher stage compressors, which further improves process efficiency.

One embodiment is directed to a heat exchanger for cooling a fluid with a mixed refrigerant, comprising:

a warm end 1 and a cold end 2;

a feed fluid cooling passage 162 having an inlet at the warm end and adapted to receive a feed fluid, and having a product outlet at the cold end through which product exits the feed fluid cooling passage;

a primary refrigeration passage 104 or 204 having an inlet at the cold end and adapted to receive a cold temperature refrigerant stream 122, a refrigerant return stream outlet at the warm end through which a vapor phase refrigerant return stream exits the primary refrigeration passage, and an inlet adapted to receive a middle temperature refrigerant stream 148 and located between the cold temperature refrigerant stream inlet and the refrigerant return stream outlet;

a high pressure vapor passage 166 adapted to receive a high pressure vapor stream 34 at the warm end and to cool the high pressure vapor stream 34 to form a mixed phase cold separator feed stream 164, and including an outlet in communication with a cold vapor separator VD4, the cold vapor separator VD4 adapted to separate the cold separator feed stream 164 into a cold separator vapor stream 160 and a cold separator liquid stream 156;

a cold separator vapor passage having an inlet in communication with the cold vapor separator VD4 and adapted to condense and flash the cold separator vapor stream 160 to form the cold temperature refrigerant stream 122, and having an outlet in communication with the primary refrigeration passage inlet at the cold end;

a cold separator liquid passage having an inlet in communication with the cold vapor separator VD4 and adapted to subcool the cold separator liquid stream, and having an outlet in communication with a middle temperature refrigerant passage;

a high pressure liquid passage 136 adapted to receive a mid-boiling refrigerant liquid stream 38 at the warm end and to cool the mid-boiling refrigerant liquid stream to form a subcooled refrigerant liquid stream 124 and having an outlet in communication with the middle temperature refrigerant passage; and the middle temperature refrigerant passage adapted to receive and combine the subcooled cold separator liquid stream 128 with the subcooled refrigerant liquid stream 124 to form a middle temperature refrigerant stream 148, and having an outlet in communication with the primary refrigeration passage inlet adapted to receive the middle temperature refrigerant stream 148.

An embodiment is directed to a method of cooling a fluid, comprising:

thermally contacting a feed fluid and a circulating mixed refrigerant in the heat exchanger of claim 1, to obtain a cooled product fluid, the circulating mixed refrigerant comprising two or more C1-C5 hydrocarbons, and optionally $N_2$.

An embodiment is directed to a compression system for circulating a mixed refrigerant in a heat exchanger, and comprising:

a suction separation device VD1 comprising an inlet for receiving a low pressure mixed refrigerant return stream 102/202 and a vapor outlet 14;

a compressor 16 in fluid communication with the vapor outlet 14 and having a compressed fluid outlet for providing a compressed fluid stream 18;

optionally, an aftercooler 20 having an inlet in fluid communication with the compressed fluid outlet and stream 18, and having an outlet for providing a cooled fluid stream 22, optionally, an interstage separation device VD2 having an inlet in fluid communication with the aftercooler outlet and stream 22, a vapor outlet for providing a vapor stream 24, and a liquid outlet for providing a high-boiling refrigerant liquid stream 48;

a compressor 26 having an inlet in fluid communication with the interstage separation device vapor outlet and stream 24, and an outlet for providing a compressed fluid stream 28;

optionally, an aftercooler 30 having an inlet in fluid communication with the compressed fluid stream 28, and an outlet for providing a high pressure mixed phase stream 32;

an accumulator separation device VD3 having an inlet in fluid communication with the high pressure mixed phase stream 32, a vapor outlet for providing a high pressure vapor stream 34, and a liquid outlet for providing a mid-boiling refrigerant liquid stream 36;

optionally, a splitting intersection having an inlet for receiving the mid-boiling refrigerant liquid stream 36, an outlet for providing a mid-boiling refrigerant liquid stream 38, and optionally an outlet for providing a fluid stream 40;

optionally, an expansion device 42 having an inlet in fluid communication with fluid stream 40, and an outlet for providing a cooled fluid stream 44; and the interstage separation device VD2 optionally further comprising an inlet for receiving the fluid stream 44;

wherein if the splitting intersection is not present, then the mid-boiling refrigerant liquid stream 36 is in direct fluid communication with mid-boiling refrigerant liquid stream 38.

An embodiment is directed to a system for cooling a fluid, comprising any heat exchanger described herein and any compression system in communication.

An embodiment is directed to a method of cooling a fluid, comprising:

thermally contacting a feed fluid and a circulating mixed refrigerant in one or more systems described herein, to obtain a cooled product fluid, the circulating mixed refrigerant comprising two or more C1-C5 hydrocarbons, and optionally $N_2$.

An embodiment is directed to a method for cooling a feed fluid, comprising:

separating a high pressure mixed refrigerant stream, said stream comprising two or more C1-C5 hydrocarbons and optionally $N_2$, to form a high pressure vapor stream and a mid-boiling refrigerant liquid stream;

cooling the high pressure vapor in a heat exchanger, to form a mixed phase stream;

separating the mixed phase stream with a cold vapor separator VD4, to form a cold separator vapor stream and a cold separator liquid stream;

condensing the cold separator vapor stream and flashing, to form a cold temperature refrigerant stream;

cooling the mid-boiling refrigerant liquid in the heat exchanger, to form a subcooled mid-boiling refrigerant liquid stream;

subcooling the cold separator liquid stream to form a subcooled cold separator liquid stream and combining with the subcooled mid-boiling refrigerant liquid stream, to form a middle temperature refrigerant stream;

combining the middle temperature refrigerant and the low pressure mixed phase stream, and warming, to form a vapor refrigerant return stream comprising the hydrocarbons and optional $N_2$; and thermally contacting the feed fluid and the heat exchanger, to form a cooled feed fluid.

DESCRIPTION OF THE SEVERAL EMBODIMENTS

Figure 2:
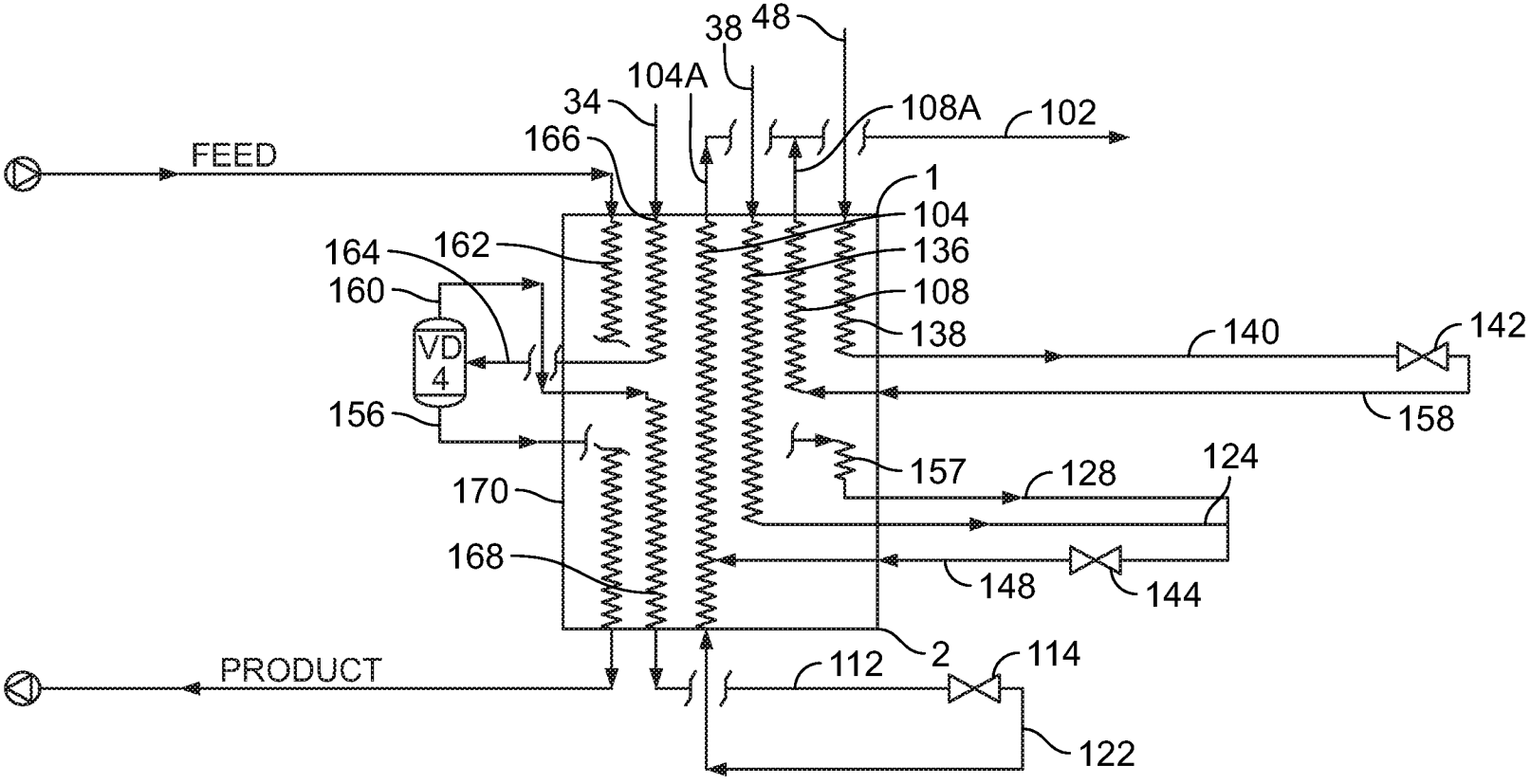
FIG. 2 is a process flow diagram and schematic illustrating an embodiment of a process and system of the invention.

A process flow diagram and schematic illustrating an embodiment of a multi-stream heat exchanger is provided in FIG. 2.

As illustrated in FIG. 2, one embodiment includes a multi-stream heat exchanger 170, having a warm end 1 and a cold end 2. The heat exchanger receives a feed fluid stream, such as a high pressure natural gas feed stream that is cooled and/or liquefied in cooling passage 162 via removal of heat via heat exchange with refrigeration streams in the heat exchanger. As a result, a stream of product fluid such as liquid natural gas is produced. The multi-stream design of the heat exchanger allows for convenient and energy-efficient integration of several streams into a single exchanger. Suitable heat exchangers may be purchased from Chart Energy & Chemicals, Inc. of The Woodlands, Tex. The plate and fin multi-stream heat exchanger available from Chart Energy & Chemicals, Inc. offers the further advantage of being physically compact.

In one embodiment, referring to FIG. 2, a feed fluid cooling passage 162 includes an inlet at the warm end 1 and a product outlet at the cold end 2 through which product exits the feed fluid cooling passage 162. A primary refrigeration passage 104 (or 204—see FIG. 3) has an inlet at the cold end for receiving a cold temperature refrigerant stream 122, a refrigerant return stream outlet at the warm end through which a vapor phase refrigerant return stream 104A exits the primary refrigeration passage 104, and an inlet adapted to receive a middle temperature refrigerant stream 148. In the heat exchanger, at the latter inlet, the primary refrigeration passage 104/204 is joined by the middle temperature refrigerant passage 148, where the cold temperature refrigerant stream 122 and the middle temperature refrigerant stream 148 combine. In one embodiment, the combination of the middle temperature refrigerant stream and the cold temperature refrigerant stream forms a middle temperature zone in the heat exchanger generally from the point at which they combine and downstream from there in the direction of the refrigerant flow toward the primary refrigerant outlet.

It should be noted herein that the passages and streams are sometimes both referred to by the same element number set out in the figures. Also, as used herein, and as known in the art, a heat exchanger is that device or an area in the device wherein indirect heat exchange occurs between two or more streams at different temperatures, or between a stream and the environment. As used herein, the terms "communication", "communicating", and the like generally refer to fluid communication unless otherwise specified. And although two fluids in communication may exchange heat upon mixing, such an exchange would not be considered to be the same as heat exchange in a heat exchanger, although such an exchange can take place in a heat exchanger. A heat exchange system can include those items though not specifically described are generally known in the art to be part of a heat exchanger, such as expansion devices, flash valves, and the like. As used herein, the term "reducing the pressure of" does not involve a phase change, while the term, "flashing", does involve a phase change, including even a partial phase change. As used herein, the terms, "high", "middle", "warm" and the like are relative to comparable streams, as is customary in the art. The stream tables of FIGS. 13A-13E and 14A-14F set out exemplary values as guidance, which are not intended to be limiting unless otherwise specified.

In an embodiment, the heat exchanger includes a high pressure vapor passage 166 adapted to receive a high pressure vapor stream 34 at the warm end and to cool the high pressure vapor stream 34 to form a mixed phase cold separator feed stream 164, and including an outlet in communication with a cold vapor separator VD4, the cold vapor separator VD4 adapted to separate the cold separator feed stream 164 into a cold separator vapor stream 160 and a cold separator liquid stream 156. In one embodiment, the high pressure vapor 34 is received from a high pressure accumulator separation device on the compression side.

In an embodiment, the heat exchanger includes a cold separator vapor passage having an inlet in communication with the cold vapor separator VD4. The cold separator vapor is cooled passage 168 condensed into liquid stream 112, and then flashed with 114 to form the cold temperature refrigerant stream 122. The cold temperature refrigerant 122 then enters the primary refrigeration passage at the cold end thereof. In one embodiment, the cold temperature refrigerant is a mixed phase.

In an embodiment, the cold separator liquid 156 is cooled in passage 157 to form subcooled cold vapor separator liquid 128. This stream can join the subcooled mid-boiling refrigerant liquid 124, discussed below, which, thus combined, are then flashed at 144 to form the middle temperature refrigerant 148, such as shown in FIG. 2. In one embodiment, the middle temperature refrigerant is a mixed phase.

In an embodiment, the heat exchanger includes a high pressure liquid passage 136. In one embodiment, the high pressure liquid passage receives a high pressure liquid 38 from a high pressure accumulator separation device on the compression side. In one embodiment, the high pressure liquid 38 is a mid-boiling refrigerant liquid stream. The high pressure liquid stream enters the warm end and is cooled to form a subcooled refrigerant liquid stream 124. As noted above, the subcooled cold separator liquid stream 128 is combined with the subcooled refrigerant liquid stream 124 to form a middle temperature refrigerant stream 148. In an embodiment, the one or both refrigerant liquids 124 and 128 can independently be flashed at 126 and 130 before combining into the middle temperature refrigerant 148, as shown for example in FIG. 4.

In an embodiment, the cold temperature refrigerant 122 and middle temperature refrigerant 148, thus combined, provide refrigeration in the primary refrigeration passage 104, where they exit as a vapor phase or mixed phase refrigerant return stream 104A/102. In an embodiment, they exit as a vapor phase refrigerant return stream 104A/102. In one embodiment, the vapor is a superheated vapor refrigerant return stream.

As shown in FIG. 2, the heat exchanger may also include a pre-cool passage adapted to receive a high-boiling refrigerant liquid stream 48 at the warm end. In one embodiment, the high-boiling refrigerant liquid stream 48 is provided by an interstage separation device between compressors on the compression side. The high-boiling liquid refrigerant stream 48 is cooled in pre-cool liquid passage 138 to form subcooled high-boiling liquid refrigerant 140. The subcooled high-boiling liquid refrigerant 140 is then flashed or has its pressure reduced at expansion device 142 to form the warm temperature refrigerant stream 158, which may be a mixed vapor liquid phase or liquid phase.

In an embodiment, the warm temperature refrigerant stream 158 enters the pre-cool refrigerant passage 108 to provide cooling. In an embodiment, the pre-cool refrigerant passage 108 provides substantial cooling for the high pressure vapor passage 166, for example, to cool and condense the high pressure vapor 34 into the mixed phase cold separator feed stream 164.

Figure 8:
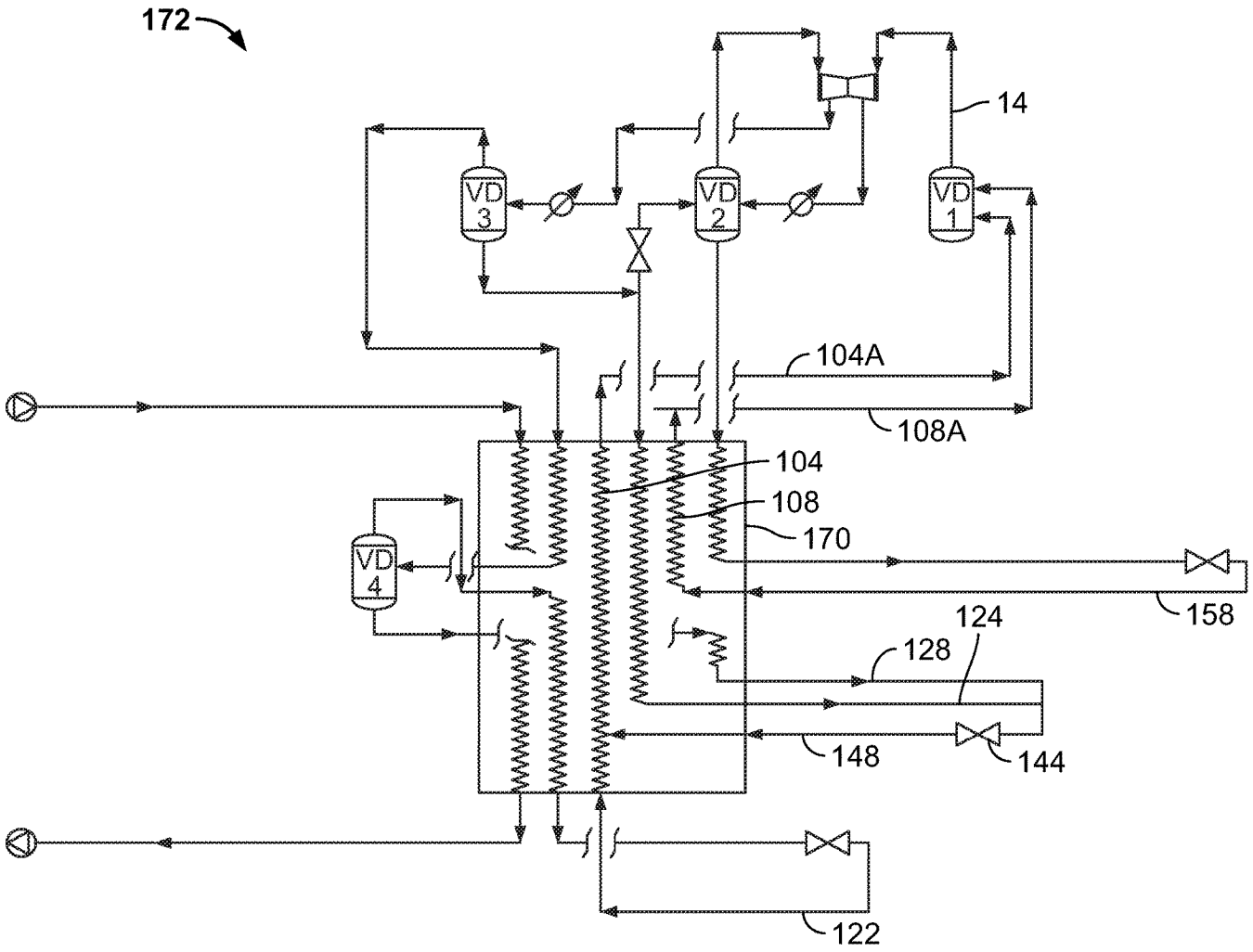
FIG. 8 is a process flow diagram and schematic illustrating a seventh embodiment of a process and system of the invention.

In an embodiment, the warm temperature refrigerant stream exits the pre-cool refrigeration passage 108 as a vapor phase or mixed phase warm temperature refrigerant return stream 108A. In an embodiment, the warm temperature refrigerant return stream 108A returns to the compression side either alone—such as shown in FIG. 8, or in combination with the refrigerant return stream 104A to form return stream 102. If combined, the return streams 108A and 104A can be combined with a mixing device. Examples of non-limiting mixing devices include but are not limited to static mixer, pipe segment, header of the heat exchanger, or combination thereof.

Figure 3:
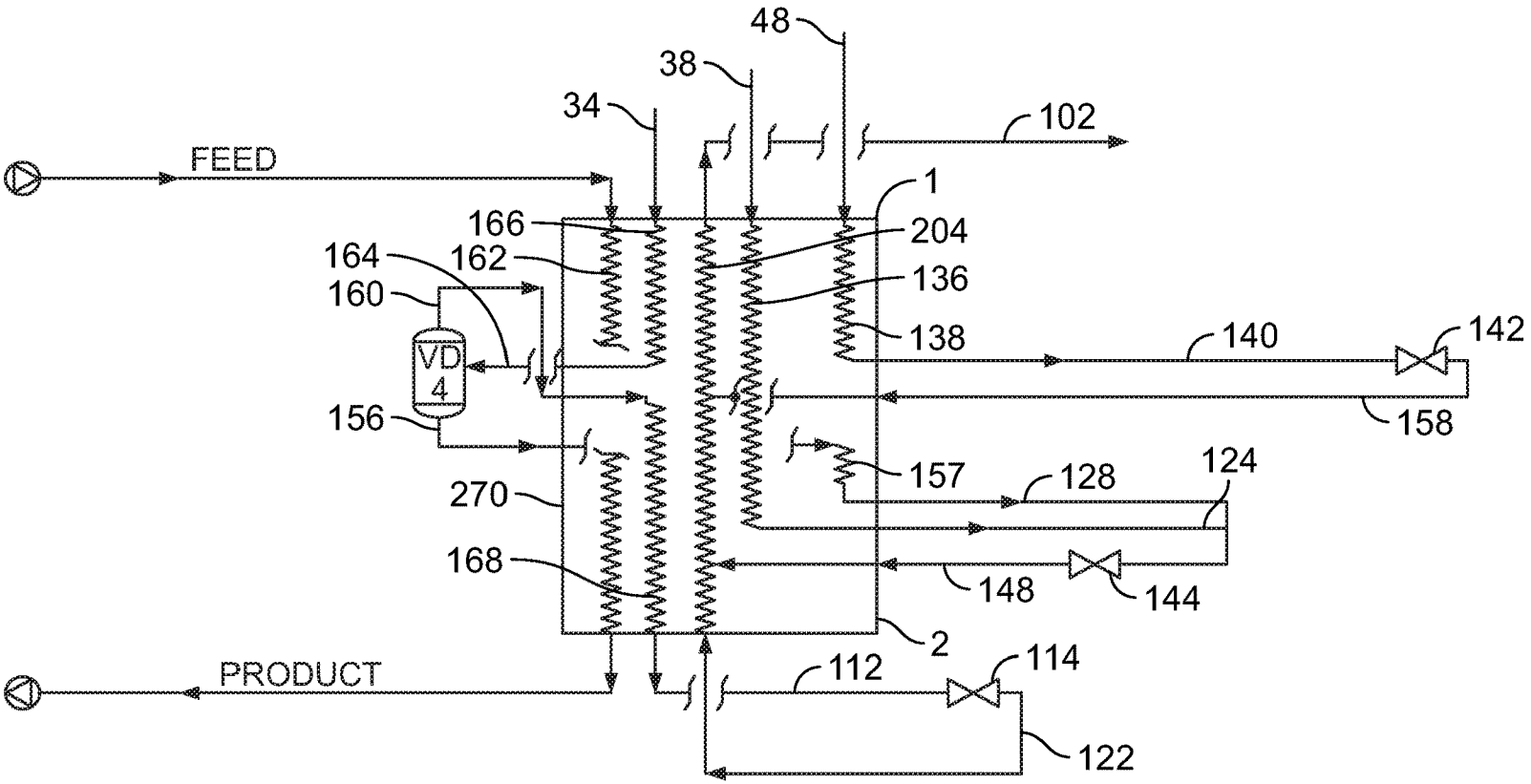
FIG. 3 is a process flow diagram and schematic illustrating a second embodiment of a process and system of the invention.

In an embodiment, the warm temperature refrigerant stream 158, rather than entering the pre-cool refrigerant passage 108, instead is introduced to the primary refrigerant passage 204, such as shown in FIG. 3. The primary refrigerant passage 204 includes an inlet downstream from the point where the middle temperature refrigerant 148 enters the primary refrigerant passage but upstream of the outlet for the return refrigerant stream 202. The cold temperature refrigerant stream 122, which was previously combined with the middle temperature refrigerant stream 148, and the warm temperature refrigerant stream 158 combine to provide warm temperature refrigeration in the corresponding area, e.g., between the refrigerant return stream outlet and the point of introduction of the warm temperature refrigerant 158 in the primary refrigeration passage 204. An example of this is shown in the heat exchanger 270 at FIG. 3. The combined refrigerants 122, 148, and 158 exit as a combined return refrigerant stream 202, which may be a mixed phase or a vapor phase. In an embodiment, the refrigerant return stream from the primary refrigeration passage 204 is a vapor phase return stream 202.

Figure 4:
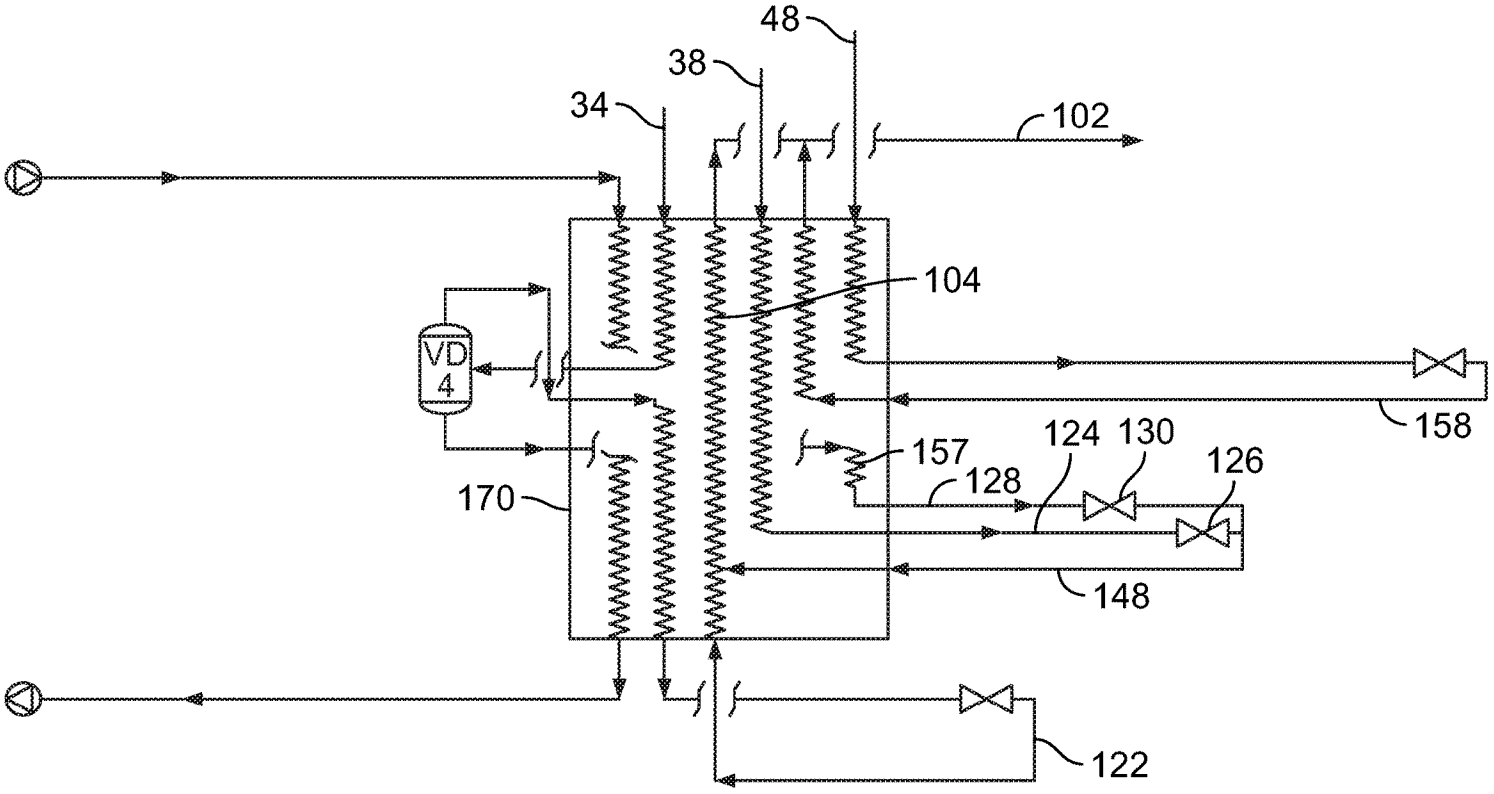
FIG. 4 is a process flow diagram and schematic illustrating a third embodiment of a process and system of the invention.
Figure 5:
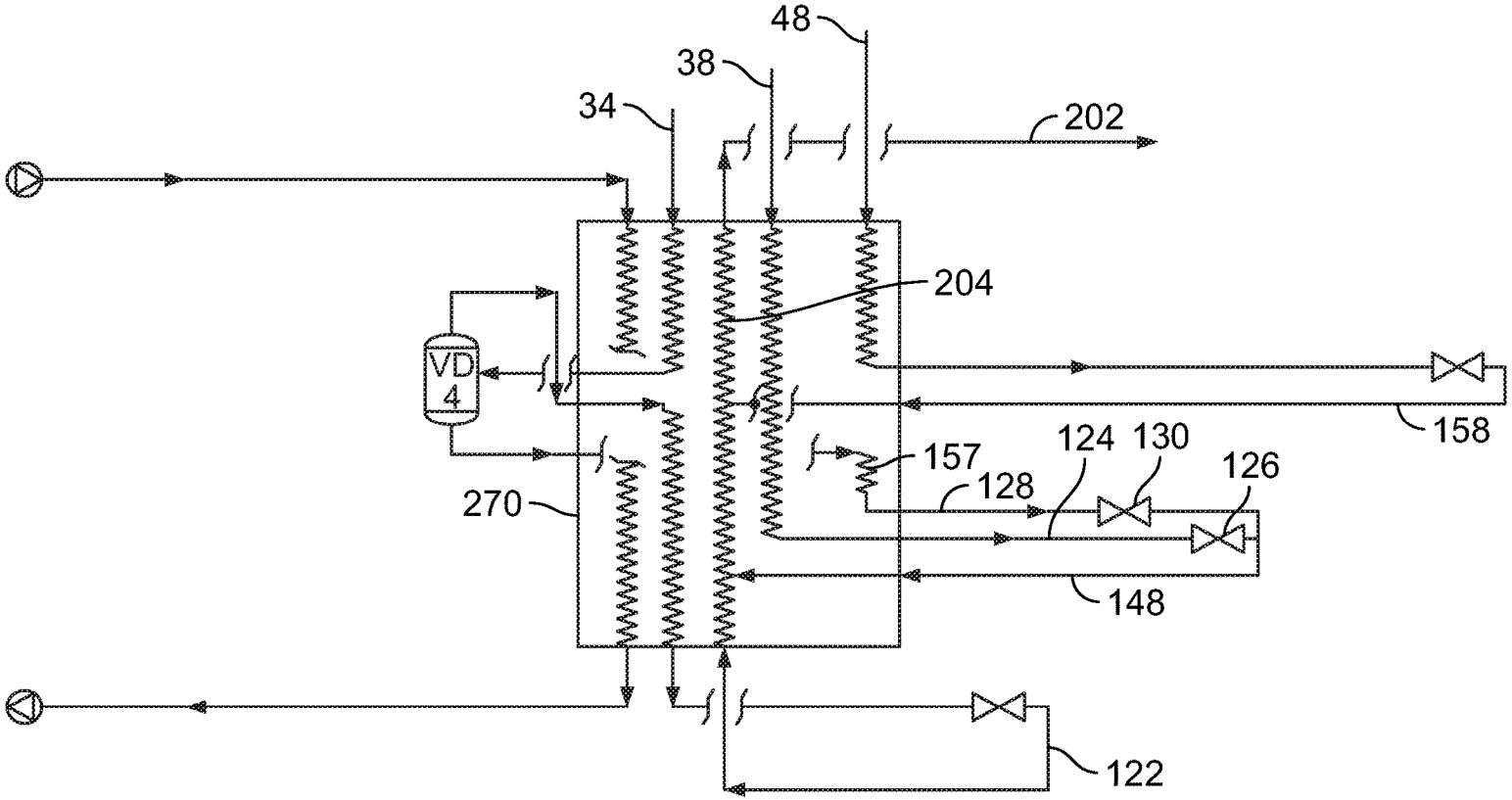
FIG. 5 is a process flow diagram and schematic illustrating a fourth embodiment of a process and system of the invention.

FIG. 5, like FIG. 4 discussed above, shows alternate arrangements for combining the subcooled cold separator liquid stream 128 and subcooled refrigerant liquid stream 124 to form the middle temperature refrigerant stream 148. In an embodiment, the one or both refrigerant liquids 124 and 128 can independently be flashed at 126 and 130 before combining into the middle temperature refrigerant 148.

Figure 6:
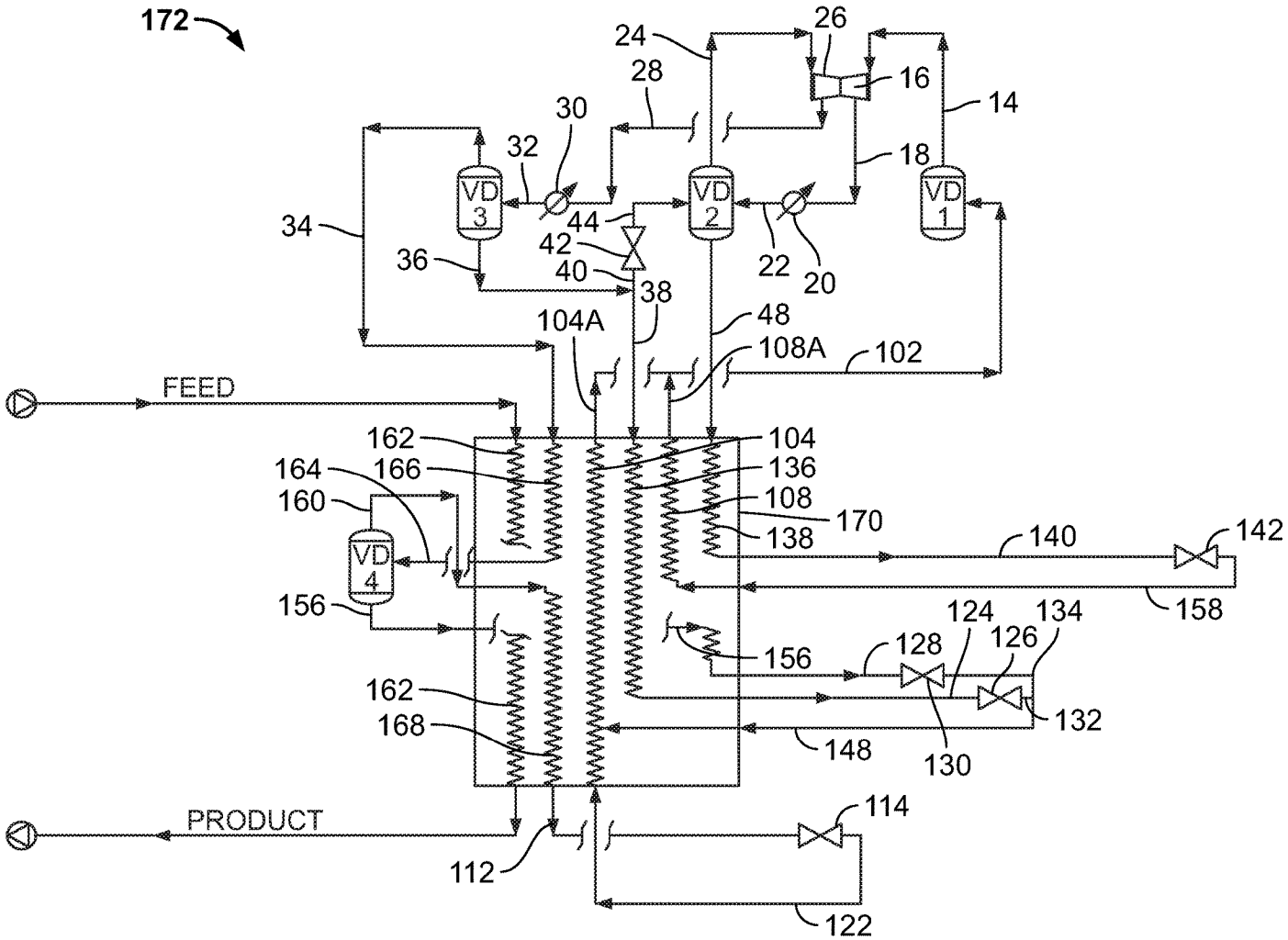
FIG. 6 is a process flow diagram and schematic illustrating a fifth embodiment of a process and system of the invention.
Figure 7:
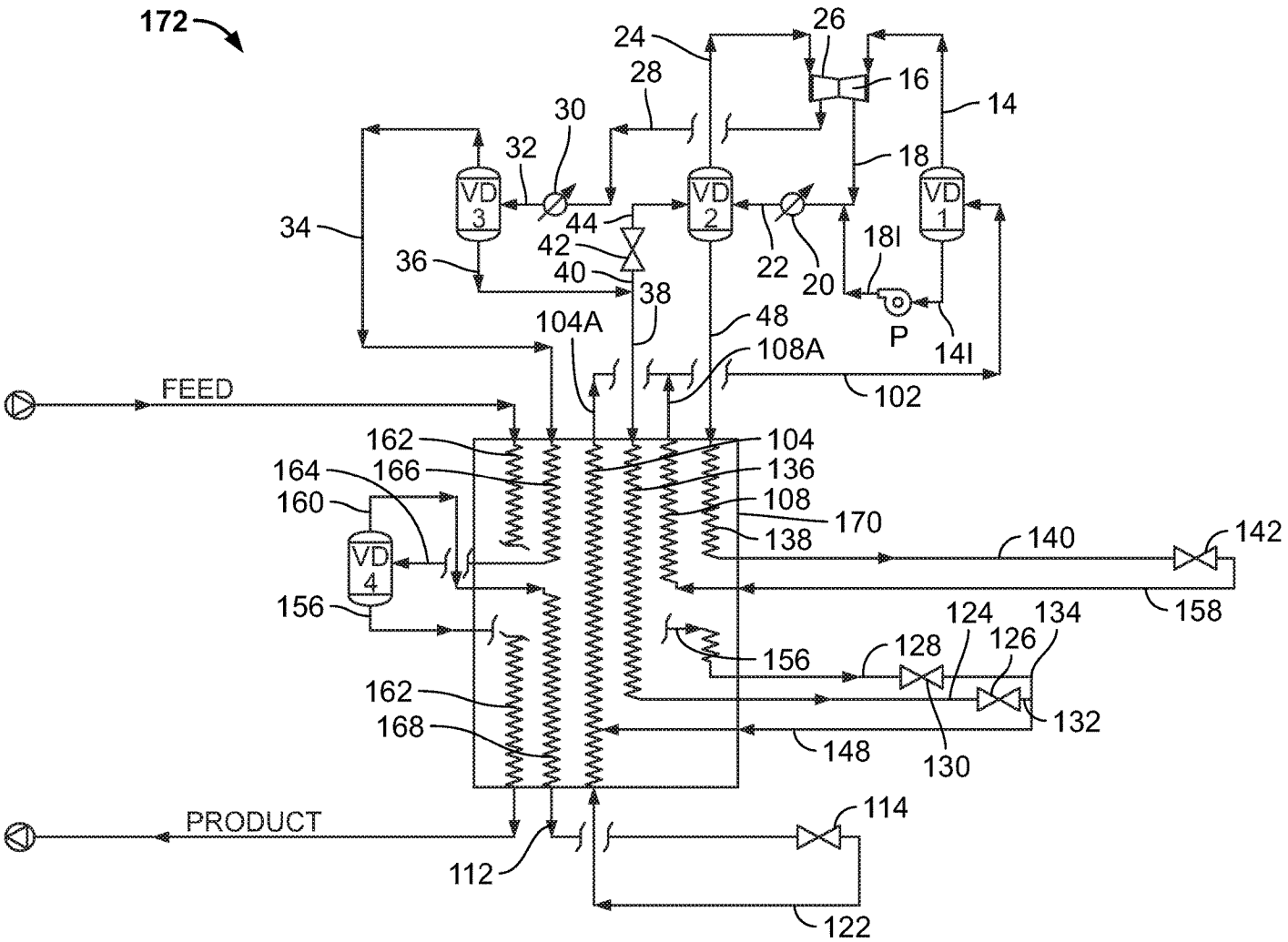
FIG. 7 is a process flow diagram and schematic illustrating a sixth embodiment of a process and system of the invention.

Referring to FIGS. 6 and 7, in which embodiments of a compression system, generally referenced as 172, are shown in combination with a heat exchanger, exemplified by 170. In an embodiment, the compression system is suitable for circulating a mixed refrigerant in a heat exchanger. Shown is a suction separation device VD1 having an inlet for receiving a low return refrigerant stream 102 (or 202, although not shown) and a vapor outlet and a vapor outlet 14. A compressor 16 is in fluid communication with the vapor outlet 14 and includes a compressed fluid outlet for providing a compressed fluid stream 18. An optional aftercooler 20 is shown for cooling the compressed fluid stream 18. If present, the aftercooler 20 provides a cooled fluid stream 22 to an interstage separation device VD2. The interstage separation device VD2 has a vapor outlet for providing a vapor stream 24 to the second stage compressor 26 and also a liquid outlet for providing a liquid stream 48 to the heat exchanger. In one embodiment the liquid stream 48 is a high-boiling refrigerant liquid stream.

Vapor stream 24 is provided to the compressor 26 via an inlet in communication with the interstage separation device VD2, which compresses the vapor 24 to provide compressed fluid stream 28. An optional aftercooler 30 if present cools the compressed fluid stream 28 to provide an a high pressure mixed phase stream 32 to the accumulator separation device VD3. The accumulator separation device VD3 separates the high pressure mixed phase stream 32 into high pressure vapor stream 34 and a high pressure liquid stream 36, which may be a mid-boiling refrigerant liquid stream. In an embodiment, the high pressure vapor stream 34 is sent to the high pressure vapor passage of the heat exchanger.

An optional splitting intersection is shown, which has an inlet for receiving the mid-high pressure liquid stream 36 from the accumulator separation device VD3, an outlet for providing a mid-boiling refrigerant liquid stream 38 to the heat exchanger, and optionally an outlet for providing a fluid stream 40 back to the interstage separation device VD2. An optional expansion device 42 for stream 40 is shown which, if present provides a an expanded cooled fluid stream 44 to the interstage separation device, the interstage separation device VD2 optionally further comprising an inlet for receiving the fluid stream 44. If the splitting intersection is not present, then the mid-boiling refrigerant liquid stream 36 is in direct fluid communication with mid-boiling refrigerant liquid stream 38.

FIG. 7 further includes an optional pump P, for pumping low pressure liquid refrigerant stream 141, the temperature of which in one embodiment has been lowered by the flash cooling effect of mixing 108A and 104A before suction separation device VD1 for pumping forward to intermediate pressure. As described above, the outlet stream 18*l* from the pump travels to the interstage drum VD2.

Figure 9:
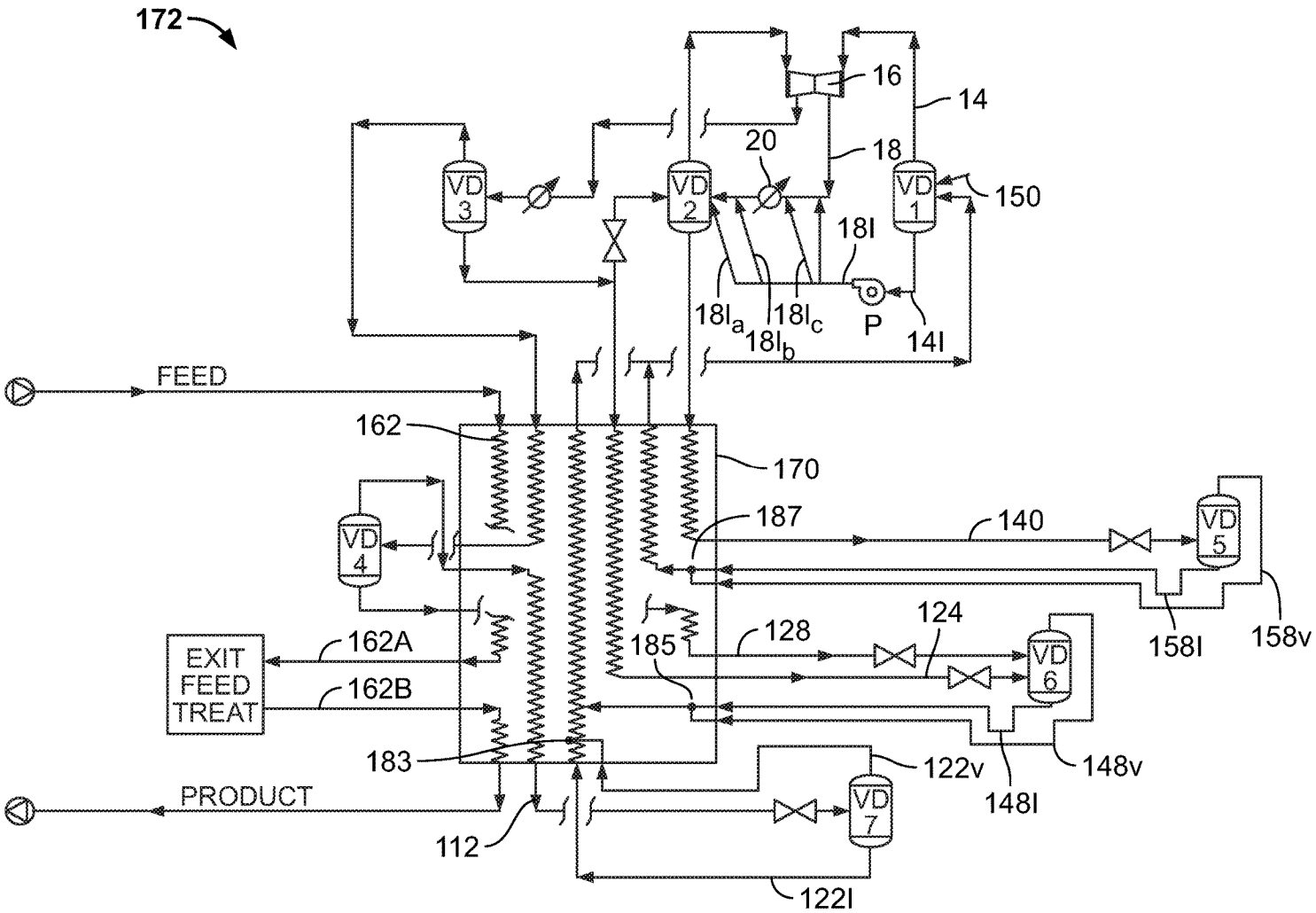
FIG. 9 is a process flow diagram and schematic illustrating an eighth embodiment of a process and system of the invention.
Figure 10:
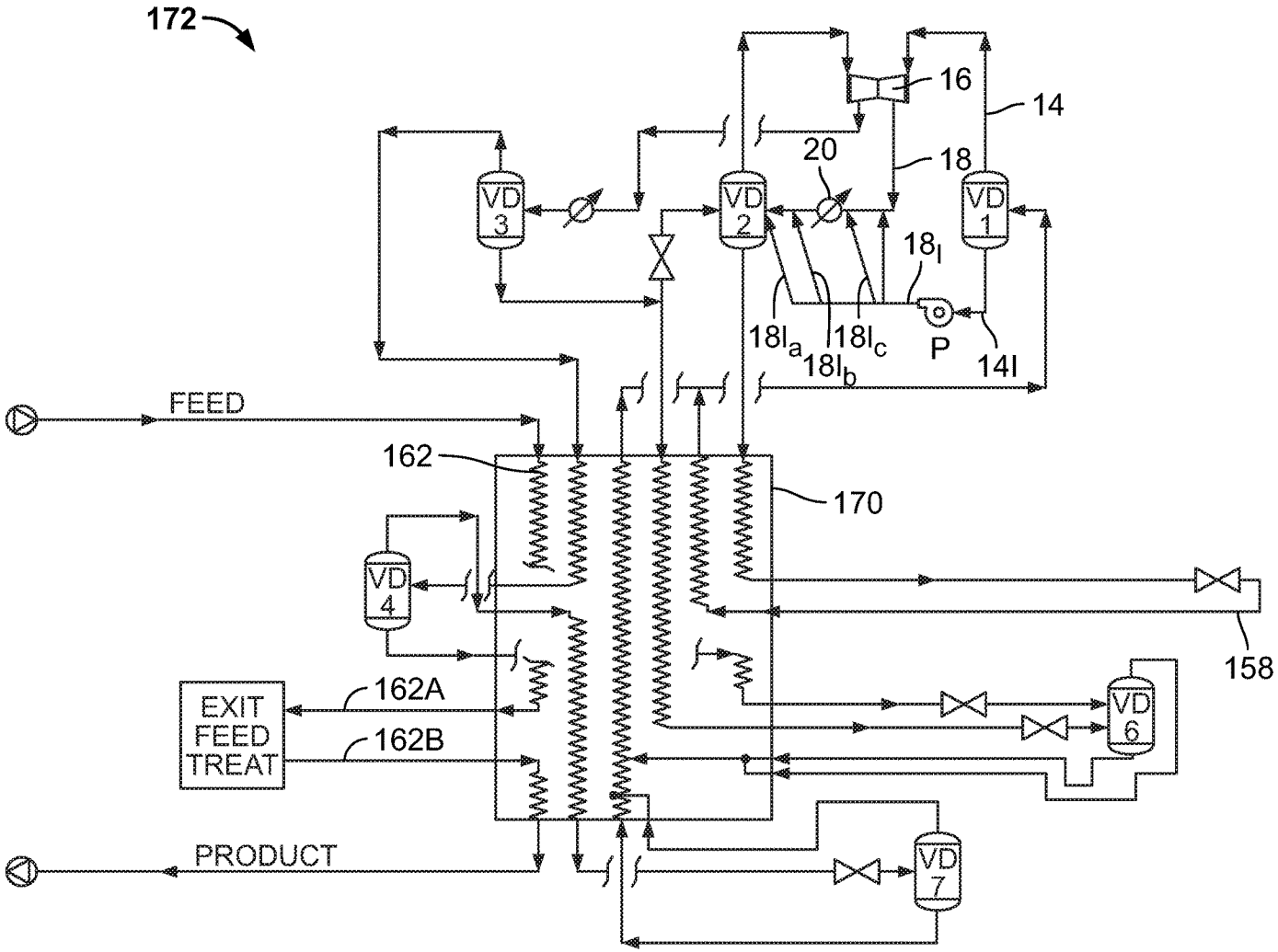
FIG. 10 is a process flow diagram and schematic illustrating a ninth embodiment of a process and system of the invention.
Figure 11:
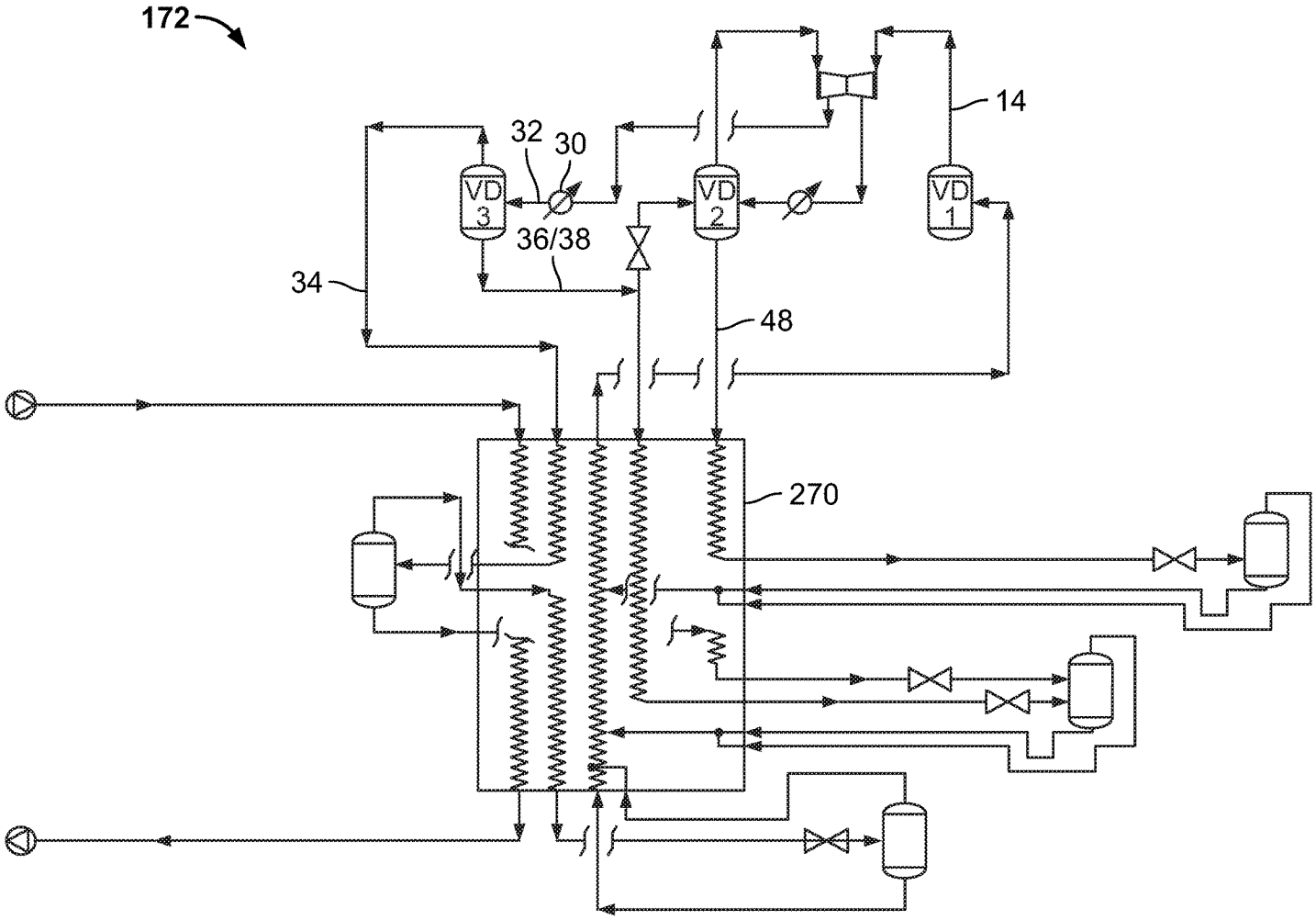
FIG. 11 is a process flow diagram and schematic illustrating a tenth embodiment of a process and system of the invention.
Figure 12:
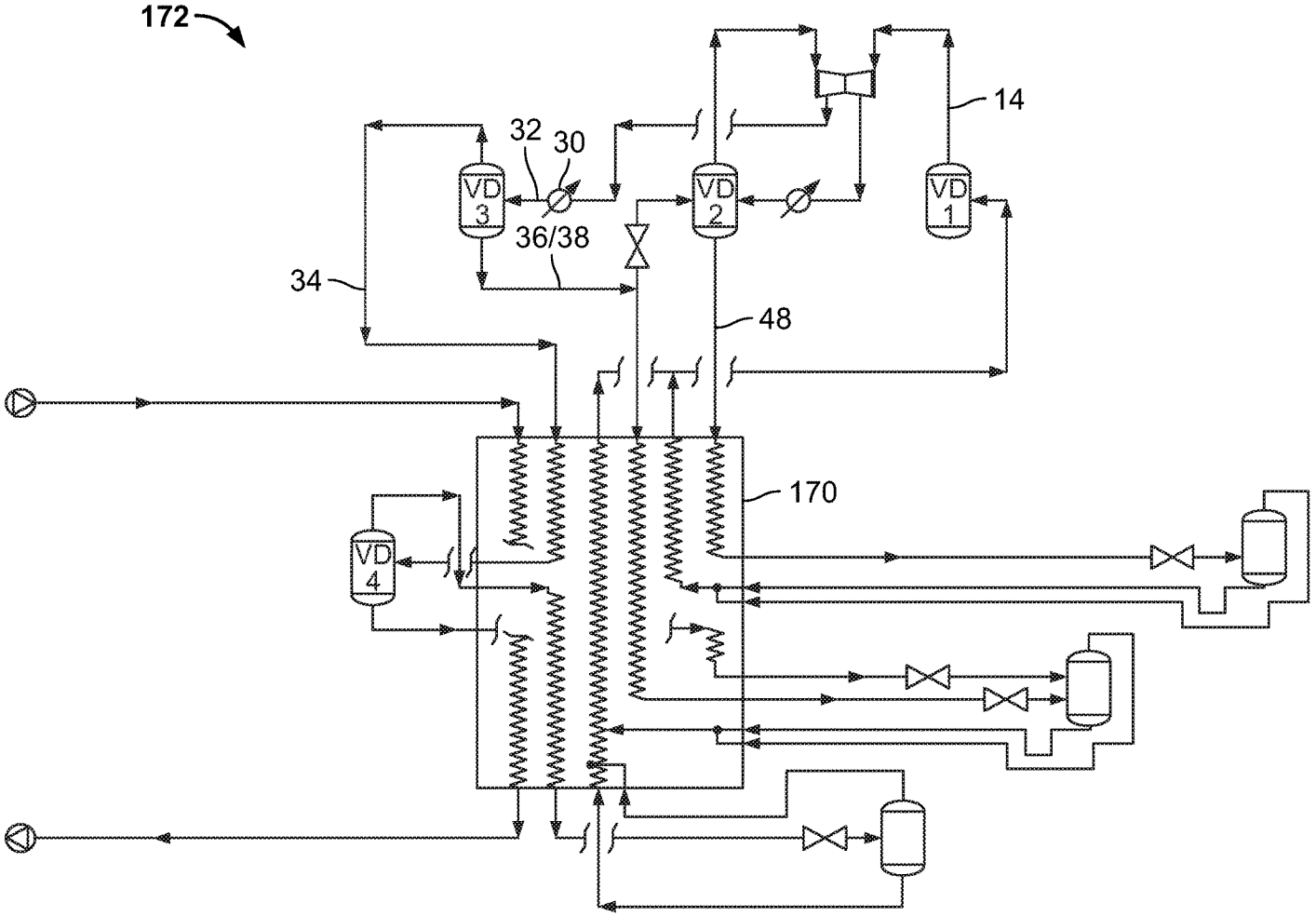
FIG. 12 is a process flow diagram and schematic illustrating an eleventh embodiment of a process and system of the invention.

FIG. 8 shows an example of different refrigerant return streams returning to suction separation device VD1. FIG. 9 shows several embodiments including feed fluid outlets and inlets 162A and 162B for external feed treatment, such as natural gas liquids recovery or nitrogen rejection, or the like.

Furthermore, while the present system and method are described below in terms of liquefaction of natural gas, they may be used for the cooling, liquefaction and/or processing of gases other than natural gas including, but not limited to, air or nitrogen.

The removal of heat is accomplished in the heat exchanger using a single mixed refrigerant in the systems described herein. Exemplary refrigerant compositions, conditions and flows of the streams of the refrigeration portion of the system, as described below, which are not intended to be limiting, are presented in FIGS. 13A-13E and 14A-14F.

In one embodiment, warm, high pressure, vapor refrigerant stream 34 is cooled, condensed and subcooled as it travels through high pressure vapor passage 166/168 of the heat exchanger 170. As a result, stream 112 exits the cold end of the heat exchanger 170. Stream 112 is flashed through expansion valve 114 and re-enters the heat exchanger as stream 122 to provide refrigeration as stream 104 traveling through primary refrigeration passage 104. As an alternative to the expansion valve 114, another type of expansion device could be used, including, but not limited to, a turbine or an orifice.

Warm, high pressure liquid refrigerant stream 38 enters the heat exchanger 170 and is subcooled in high pressure liquid passage 136. The resulting stream 124 exits the heat exchanger and is flashed through expansion valve 126. As an alternative to the expansion valve 126, another type of expansion device could be used, including, but not limited to, a turbine or an orifice. Significantly, the resulting stream 132 rather than re-entering the heat exchanger 170 directly to join the primary refrigeration passage 104, first joins the subcooled cold separator vapor liquid 128 to form a middle temperature refrigerant stream 148. The middle temperature refrigerant stream 148 then re-enters the heat exchanger wherein it joins the low pressure mixed phase stream 122 in primary refrigeration passage 104. Thus combined, and warmed, the refrigerants exit the warm end of the heat exchanger 170 as vapor refrigerant return stream 104A, which may be optionally superheated.

In one embodiment, vapor refrigerant return stream 104A and stream 108A which, may be mixed phase or vapor phase, may exit the warm end of the heat exchanger separately, e.g., each through a distinct outlet, or they may be combined within the heat exchanger and exit together, or they may exit the heat exchanger into a common header attached to the heat exchanger before returning to the suction separation device VD1. Alternatively, streams 104A and 108A may exit separately and remain so until combining in the suction separation device VD1, or they may, through vapor and mixed phase inlets, respectively, and are combined and equilibrated in the low pressure suction drum. While a suction drum VD1 is illustrated, alternative separation devices may be used, including, but not limited to, another type of vessel, a cyclonic separator, a distillation unit, a coalescing separator or mesh or vane type mist eliminator. As a result, a low pressure vapor refrigerant stream 14 exits the vapor outlet of drum VD1. As stated above, the stream 14 travels to the inlet of the first stage compressor 16. The blending of mixed phase stream 108A with stream 104A, which includes a vapor of greatly different composition, in the suction drum VD1 at the suction inlet of the compressor 16 creates a partial flash cooling effect that lowers the temperature of the vapor stream traveling to the compressor, and thus the compressor itself, and thus reduces the power required to operate it.

In one embodiment, a pre-cool refrigerant loop enters the warm side of the heat exchanger 170 and exits with a significant liquid fraction. The partially liquid stream 108A is combined with spent refrigerant vapor from stream 104A for equilibration and separation in suction drum VD1, compression of the resultant vapor in compressor 16 and pumping of the resulting liquid by pump P. In the present case, equilibrium is achieved as soon as mixing occurs, i.e., in the header, static mixer, or the like. In one embodiment, the drum merely protects the compressor. The equilibrium in suction drum VD1 reduces the temperature of the stream entering the compressor 16, by both heat and mass transfer, thus reducing the power usage by the compressor.

Other embodiments shown in FIG. 9 include various separation devices in the warm, middle, and cold refrigeration loops. In one embodiment, warm temperature refrigerant passage 158 is in fluid communication with a separation device.

In one embodiment, the warm temperature refrigerant passage 158 is in fluid communication with an accumulator separation device VD5 having a vapor outlet in fluid communication with a warm temperature refrigerant vapor passage 158*v* and a liquid outlet in fluid communication with a warm temperature refrigerant liquid passage 158*l*.

In one embodiment, the warm temperature refrigerant vapor and liquid passages 158*v* and 158*l* are in fluid communication with the low pressure high-boiling stream passage 108.

In one embodiment, the warm temperature refrigerant vapor and liquid passages 158*v* and 158*l* are in fluid communication with each other either inside the heat exchanger or in a header outside the heat exchanger.

In one embodiment, the flashed cold separator liquid stream passage 134 is in fluid communication with an accumulator separation device VD6 having a vapor outlet in fluid communication with a middle temperature refrigerant vapor passage 148*v*, and a liquid outlet in fluid communication with a middle temperature refrigerant liquid passage 148*l*.

In one embodiment, the middle temperature refrigerant vapor and liquid passages 148*v* and 148*l* are in fluid communication with the low pressure mixed refrigerant passage 104.

In one embodiment, the middle temperature refrigerant vapor and liquid passages 148*v* and 148*l* are in fluid communication with each other either inside the heat exchanger or in a header outside the heat exchanger.

In one embodiment, the flashed mid-boiling refrigerant liquid stream passage 132 is in fluid communication with an accumulator separation device VD6 having a vapor outlet in fluid communication with a middle temperature refrigerant vapor passage 148*v* and a liquid outlet in fluid communication with a middle temperature refrigerant liquid passage 148*l*.

In one embodiment, the middle temperature refrigerant vapor and liquid passages 148*v* and 148*l* are in fluid communication with the low pressure mixed refrigerant passage 104.

In one embodiment, the middle temperature refrigerant vapor and liquid passages 148*v* and 148*l* are in fluid communication with each other either inside the heat exchanger or in a header outside the heat exchanger.

In one embodiment, the flashed mid-boiling refrigerant liquid stream 132 and the flashed cold separator liquid stream 134 are in fluid communication with an accumulator separation device VD6 having a vapor outlet in fluid communication with a middle temperature refrigerant vapor passage 148*v* and a liquid outlet in fluid communication with a middle temperature refrigerant liquid passage 148*l*.

In one embodiment, the middle temperature refrigerant vapor and liquid passages 148*v* and 148*l* are in fluid communication with the low pressure mixed refrigerant passage 104.

In one embodiment, the middle temperature refrigerant vapor and liquid passages 148*v* and 148*l* are in fluid communication with each other either inside the heat exchanger or in a header outside the heat exchanger.

In one embodiment, the flashed mid-boiling refrigerant liquid stream 132 and the flashed cold separator liquid stream 134 are in fluid communication with each other prior to fluidly communicating with the accumulator separation device VD6.

In one embodiment, the low pressure mixed phase stream passage 122 is in fluid communication with an accumulator separation device VD7 having a vapor outlet in fluid communication with a cold temperature refrigerant vapor passage 122*v*, and a cold temperature liquid passage 122*l*.

In one embodiment, the cold temperature refrigerant vapor passage 122*v* and a cold temperature liquid passage 122*l* are in fluid communication with the low pressure mixed refrigerant passage 104.

In one embodiment, the cold temperature refrigerant vapor passage 122*v* and cold temperature liquid passage 122*l* are in fluid communication with each other either inside the heat exchanger or in a header outside the heat exchanger.

In one embodiment, each of the warm temperature refrigerant passage 158, flashed cold separator liquid stream passage 134, low pressure mid-boiling refrigerant passage 132, low pressure mixed phase stream passage 122 is in fluid communication with a separation device.

In one embodiment, one or more precooler may be present in series between elements 16 and VD2.

In one embodiment, one or more precooler may be present in series between elements 30 and VD3.

In one embodiment, a pump may be present between a liquid outlet of VD1 and the inlet of VD2. In some embodiments, a pump may be present between a liquid outlet of VD1 and having an outlet in fluid communication with elements 18 or 22.

In one embodiment, the pre-cooler is a propane, ammonia, propylene, ethane, pre-cooler.

In one embodiment, the pre-cooler features 1, 2, 3, or 4 multiple stages. In one embodiment, the mixed refrigerant comprises 2, 3, 4, or 5 C1-C5 hydrocarbons and optionally N2.

In one embodiment, the suction separation device includes a liquid outlet and further comprising a pump having an inlet and an outlet, wherein the outlet of the suction separation device is in fluid communication with the inlet of the pump, and the outlet of the pump is in fluid communication with the outlet of the after-cooler.

In one embodiment, the mixed refrigerant system a further comprising a pre-cooler in series between the outlet of the intercooler and the inlet of the interstage separation device and wherein the outlet of the pump is also in fluid communication with the pre-cooler.

In one embodiment, the suction separation device is a heavy component refrigerant accumulator whereby vaporized refrigerant traveling to the inlet of the compressor is maintained generally at a dew point.

In one embodiment, the high pressure accumulator is a drum.

In one embodiment, an interstage drum is not present between the suction separation device and the accumulator separation device.

In one embodiment, the first and second expansion devices are the only expansion devices in closed-loop communication with the main process heat exchanger.

In one embodiment, an after-cooler is the only after-cooler present between the suction separation device and the accumulator separation device.

In one embodiment, the heat exchanger does not have a separate outlet for a pre-cool refrigeration passage.

INCORPORATION BY REFERENCE

The contents of U.S. patent application Ser. No. 12/726,142, filed Mar. 17, 2010, and U.S. Pat. No. 6,333,445, issued Dec. 25, 2001, are hereby incorporated by reference.

While the preferred embodiments of the invention have been shown and described, it will be apparent to those skilled in the art that changes and modifications may be made therein without departing from the spirit of the invention, the scope of which is defined by the claims and elsewhere herein.

What is claimed is:

1. A method for cooling a feed fluid, comprising:

separating, in a high pressure separation device at the same pressure, a high pressure mixed refrigerant stream, said stream comprising two or more C1-C5 hydrocarbons and optionally N2, to form a high pressure vapor stream and a mid-boiling refrigerant liquid stream;

cooling the high pressure vapor stream in a heat exchanger to form a mixed phase stream;

separating the mixed phase stream with a cold vapor separator, to form a cold separator vapor stream and a cold separator liquid stream;

condensing the cold separator vapor stream in the heat exchanger and flashing, to form a cold temperature refrigerant stream;

subcooling at least a portion of the mid-boiling refrigerant liquid stream in a first heat exchange passage in the heat exchanger to a subcooled state and temperature, where the first heat exchange passage has a first heat exchange passage length, to form a subcooled mid-boiling refrigerant liquid stream;

subcooling the cold separator liquid stream in a second heat exchange passage in the heat exchanger to a subcooled state and temperature, where the second heat exchange passage has a second heat exchange passage length, prior to combination with the subcooled mid-boiling refrigerant liquid stream to form a subcooled cold separator liquid stream, wherein the first heat exchange passage is separate and distinct from the second heat exchange passage and the first heat exchange passage length is greater than the second heat exchange passage length;

combining the subcooled mid-boiling refrigerant liquid stream and the subcooled cold separator liquid stream while the subcooled mid-boiling refrigerant liquid stream is at, or colder via expansion than, the temperature of the subcooled mid-boiling refrigerant liquid stream in the subcooled state and the subcooled cold separator liquid stream is at, or colder via expansion than, the temperature of the subcooled cold separator liquid stream in the subcooled state to form a middle temperature refrigerant stream;

combining, in the heat exchanger, the middle temperature refrigerant stream with one of a cold temperature rejoined refrigerant stream and the cold temperature refrigerant stream, after the subcooled mid-boiling refrigerant liquid stream and the subcooled cold separator liquid stream are combined to form the middle temperature refrigerant stream, and warming, to form a vapor refrigerant return stream comprising the hydrocarbons and optional N2; and thermally contacting the feed fluid in the heat exchanger, to form a cooled feed fluid.

2. The method of claim 1 further comprising the step of expanding the combined subcooled cold separator liquid and subcooled mid-boiling refrigerant liquid streams to form the middle temperature refrigerant stream.

3. The method of claim 2 wherein the step of expanding the combined subcooled cold separator liquid and subcooled mid-boiling refrigerant liquid streams includes flashing the combined subcooled cold separator liquid and subcooled mid-boiling refrigerant liquid streams.

4. The method of claim 1 further comprising the steps of:

cooling a high-boiling liquid refrigerant stream in the heat exchanger to form a subcooled high-boiling liquid refrigerant;

expanding the subcooled high-boiling liquid refrigerant to form a pre-cool refrigerant stream;

warming the pre-cool refrigerant stream to form a pre-cool refrigerant return stream that is vapor phase or mixed phase.

5. The method of claim 4 wherein the step of expanding the subcooled high-boiling liquid refrigerant to form a pre-cool refrigerant stream includes flashing the subcooled high-boiling liquid refrigerant.

6. The method of claim 5 further comprising the steps of separating the pre-cool refrigerant stream into a pre-cool vapor refrigerant stream and a pre-cool liquid refrigerant stream and rejoining the pre-cool vapor refrigerant and pre-cool liquid refrigerant streams prior to warming.

7. The method of claim 4 further comprising the step of combining the pre-cool refrigerant stream with the combined middle temperature refrigerant and cold temperature refrigerant streams.

8. The method of claim 7 further comprising the steps of expanding the subcooled cold separator liquid stream and expanding the subcooled mid-boiling refrigerant liquid stream before combining the subcooled cold separator liquid stream and the subcooled mid-boiling refrigerant liquid stream.

9. The method of claim 8 wherein the step of expanding the subcooled cold separator liquid stream includes flashing the subcooled cold separator liquid stream and the step of expanding the subcooled mid-boiling refrigerant liquid stream includes flashing the subcooled mid-boiling refrigerant liquid stream.

10. The method of claim 7 further comprising the step of expanding the subcooled cold separator liquid stream.

11. The method of claim 7 further comprising the step of expanding the subcooled mid-boiling refrigerant liquid stream.

12. The method of claim 7 further comprising the step of expanding the combined subcooled cold separator liquid and subcooled mid-boiling refrigerant liquid streams to form the middle temperature refrigerant stream.

13. The method of claim 4 further comprising the step of expanding the combined subcooled cold separator liquid and subcooled mid-boiling refrigerant liquid streams to form the middle temperature refrigerant stream.

14. The method of claim 7 wherein the step of expanding the subcooled high-boiling liquid refrigerant to form a pre-cool refrigerant stream includes flashing the subcooled high-boiling liquid refrigerant and further comprising the steps of separating the pre-cool refrigerant stream into a pre-cool vapor refrigerant stream and a pre-cool liquid refrigerant stream and rejoining the pre-cool vapor refrigerant and pre-cool liquid refrigerant streams prior to combination with the middle temperature refrigerant and cold temperature refrigerant streams.

15. The method of claim 1 further comprising the steps of expanding the subcooled cold separator liquid stream and expanding the subcooled mid-boiling refrigerant liquid stream before combining the subcooled cold separator liquid stream and the subcooled mid-boiling refrigerant liquid stream.

16. The method of claim 15 wherein the step of expanding the subcooled cold separator liquid stream includes flashing the subcooled cold separator liquid stream and the step of expanding the subcooled mid-boiling refrigerant liquid stream includes flashing the subcooled mid-boiling refrigerant liquid stream.

17. The method of claim 16 further comprising the steps of combining the flashed subcooled cold separator liquid stream and the flashed subcooled mid-boiling refrigerant liquid stream and forming a middle temperature refrigerant liquid stream and a middle temperature refrigerant vapor stream and rejoining the middle temperature refrigerant liquid and middle temperature refrigerant vapor streams prior to combination with the cold temperature refrigerant stream.

18. The method of claim 1 further comprising the step of expanding the subcooled cold separator liquid stream.

19. The method of claim 1 further comprising the step of expanding the subcooled mid-boiling refrigerant liquid stream.

20. The method of claim 1 further comprising the steps of separating the cold temperature refrigerant stream to form a cold temperature liquid refrigerant stream and a cold temperature vapor refrigerant stream and rejoining the cold temperature liquid refrigerant stream and the cold temperature vapor refrigerant stream to form the cold temperature rejoined refrigerant stream, prior to combination with the middle temperature refrigerant stream.

21. The method of claim 1 wherein the cold separator liquid stream is colder than the mid-boiling refrigerant liquid stream.

22. A method for cooling a feed fluid, comprising:

separating, in a high pressure separation device at the same pressure, a high pressure mixed refrigerant stream, said stream comprising two or more C1-C5 hydrocarbons and optionally N2, to form a high pressure vapor stream and a mid-boiling refrigerant liquid stream;

cooling the high pressure vapor stream in a heat exchanger to form a mixed phase stream;

separating the mixed phase stream with a cold vapor separator, to form a cold separator vapor stream and a cold separator liquid stream;

condensing the cold separator vapor stream in the heat exchanger and flashing, to form a cold temperature refrigerant stream;

subcooling at least a portion of the mid-boiling refrigerant liquid stream in a first heat exchange passage in the heat exchanger to a subcooled state and temperature, where the first heat exchange passage has a first heat exchange passage length, to form a subcooled mid-boiling refrigerant liquid stream;

subcooling the cold separator liquid stream in a second heat exchange passage in the heat exchanger to a subcooled state and temperature, where the second heat exchange passage has a second heat exchange passage length, prior to combination with the subcooled mid-boiling refrigerant liquid stream to form a subcooled cold separator liquid stream, wherein the first heat exchange passage is separate and distinct from the second heat exchange passage and the first heat exchange passage length is greater than the second heat exchange passage length;

directing the subcooled mid-boiling refrigerant liquid stream and the subcooled cold separator liquid stream individually and directly, before or after expansion, to a mixing junction;

combining the subcooled mid-boiling refrigerant liquid stream and the subcooled cold separator liquid stream while the subcooled mid-boiling refrigerant liquid stream is at, or colder via expansion than, the temperature of the subcooled mid-boiling refrigerant liquid stream in the subcooled state and the subcooled cold separator liquid stream is at, or colder via expansion than, the temperature of the subcooled cold separator liquid stream in the subcooled state at the mixing junction to form a middle temperature refrigerant stream;

combining the middle temperature refrigerant stream and the cold temperature refrigerant stream in the heat exchanger, after the subcooled mid-boiling refrigerant liquid stream and the subcooled cold separator liquid stream are combined to form the middle temperature refrigerant stream, and warming, to form a vapor refrigerant return stream comprising the hydrocarbons and optional N2; and thermally contacting the feed fluid in the heat exchanger, to form a cooled feed fluid.

23. The method of claim 22 wherein the cold separator liquid stream is colder than the mid-boiling refrigerant liquid stream.

* * * * *